US011198993B2

(12) United States Patent
Perez et al.

(10) Patent No.: US 11,198,993 B2
(45) Date of Patent: Dec. 14, 2021

(54) DRAIN FITTING DEVICE

(71) Applicant: NuWhirl Systems Corporation, Corona, CA (US)

(72) Inventors: Diego David Perez, Menifee, CA (US); Dale A. Van Spengen, Ontario (CA); Lee Lina Ourn, Riverside, CA (US)

(73) Assignee: NuWhirl Systems Corporation, Corona, CA (US)

( * ) Notice: Subject to any disclaimer, the term of this patent is extended or adjusted under 35 U.S.C. 154(b) by 0 days.

(21) Appl. No.: 16/938,849

(22) Filed: Jul. 24, 2020

(65) Prior Publication Data

US 2021/0025151 A1 Jan. 28, 2021

Related U.S. Application Data

(60) Provisional application No. 62/878,300, filed on Jul. 24, 2019.

(51) Int. Cl.
*E03C 1/23* (2006.01)

(52) U.S. Cl.
CPC .... *E03C 1/2302* (2013.01); *E03C 2001/2311* (2013.01)

(58) Field of Classification Search
CPC ..... E03C 2001/2315; E03C 2001/2317; E03C 2001/2311; E03C 2001/232; E03C 1/2302; E03C 1/232; E03C 1/23
See application file for complete search history.

(56) References Cited

U.S. PATENT DOCUMENTS

| | | | | |
|---|---|---|---|---|
| 2,989,758 | A * | 6/1961 | Turek | E03C 1/2302 4/689 |
| 9,187,885 | B2 | 11/2015 | Schulze | |
| 2009/0007322 | A1 * | 1/2009 | Taylor | E03C 1/242 4/293 |
| 2011/0099711 | A1 * | 5/2011 | Cerutti | E03C 1/23 4/689 |

* cited by examiner

*Primary Examiner* — Janie M Loeppke
(74) *Attorney, Agent, or Firm* — Knobbe Martens Olson & Bear, LLP

(57) ABSTRACT

This disclosure relates to drains in bathing environments. A drain fitting device can have a motor to actuate a cam to maneuver a drain stopper, enabling the flow of fluid through a drain inlet of a bathing environment. The drain fitting device can provide a motorized or actuated method for a user to quickly and reliably open a drain stopper of a bathing environment.

26 Claims, 24 Drawing Sheets

DRAIN FITTING DEVICE

FIELD

This disclosure relates to drain fittings and associated components. In particular, this disclosure relates to drain fittings that can actuate a cam to maneuver a drain stopper, enabling the flow of fluid through a drain such as in a bathing environment.

BACKGROUND

Stoppers are often used to plug and unplug drain inlets to facilitate the draining of bathing environments such as bath tubs. It can be inconvenient and even dangerous if a user is unable to quickly and reliably drain a bathing environment. For example, a user may be unable to exit a walk-in bathing environment until draining is complete by the door of the walk-in bathing environment not being able to be opened with water still present in the walk-in bathing environment. This can be dangerous, including in the case of a medical emergency. This can also be inconvenient for the user as draining can take a substantial amount of time. Accordingly, it is desirable to have draining solutions.

SUMMARY

It is desirable to have drain fitting devices that can ensure that a stopper will not impede a drain inlet when a user desires to empty a bathing environment. Cable systems can be used to operate a system that positions a stopper to open and close a drain inlet. These cable systems, however, can fail. As such, the drain fitting devices, systems, and assemblies described herein provide a reliable alternative to a cable system, which can increase safety and improve user experience by reducing drain failing occurrences. The drain fitting devices, systems, and assemblies described herein can also reduce the risk of mechanical failure by decoupling a cam from the stopper.

In some embodiments, a drain fitting device for draining a bathing environment can include one or more of the following: a drain inlet and a drain outlet, wherein a drain periphery extends between the drain inlet and the drain outlet to define a chamber, the chamber being configured to direct fluid from the drain inlet to the drain outlet; a cam positioned within the chamber, the cam being configured to rotate in a first direction such that the cam pushes a stopper into an open position that allows fluid to flow through the drain inlet, and wherein the cam is configured to rotate in a second direction such that the cam does not engage the stopper, enabling the stopper to be in a closed position that prevents flow of fluid through the drain inlet; a plunger rotatably coupled to the cam, the plunger comprising a plunger tab radially extending from the plunger, the plunger tab configured to interface with a cable of a handle lever such that rotating the handle lever manipulates the cable to cause the plunger to rotate, resulting in the cam rotating in the first direction or the second direction; a plunger union that interfaces with the plunger, the plunger union comprising a plunger union tab axially extending from the plunger union, the plunger union tab configured to engage the plunger tab of the plunger such that the plunger rotates with the plunger union, and wherein the plunger union is configured to rotate to a disengaged position in which the plunger union tab is not engaging the plunger tab of the plunger, enabling the plunger to rotate relative to the plunger union; and/or a motor configured to rotate the plunger union, wherein the rotation of the plunger union engages the plunger union tab with the plunger tab of the plunger, causing the plunger to rotate with the plunger union such that the cam is rotated in the first direction so that the stopper is pushed into an open position, allowing fluid to flow through the drain inlet.

In some embodiments, the drain fitting device can further include one or more of the following: a housing within which the plunger and the plunger union are at least partially positioned; a housing cover that couples the motor to the housing, and wherein the housing cover comprises an aperture that enables the plunger union to engage with the motor through the housing; the motor is an electric motor comprising a capacitor that is configured to store energy such that the motor can rotate the plunger union without an external power source; the plunger comprises a central aperture that is configured to receive a portion of the plunger union; the portion of the plunger union is configured to be inserted into the central aperture of the plunger such that the plunger union tab of the plunger union is offset from an outer surface of the plunger; the plunger union tab is curved and comprises a radius of curvature corresponding to a curvature of an outer surface of the portion of the plunger union; the plunger comprises grooves configured to receive o-rings to prevent fluid from leaking from the chamber; the plunger union comprises grooves configured to receive o-rings to prevent fluid from contacting the motor; the cam comprises a lever that is configured to interface with the stopper, and wherein the lever comprises two curved elongate surfaces and two flat parallel surfaces; plunger tab two offset tabs comprise the plunger tab, and wherein each of the two offset tabs comprises an aperture, the aperture configured to interface with the cable of the handle lever; the motor is configured to rotate the plunger union until triggering a switch, causing the motor to stop the rotation of the plunger union; the drain inlet is larger than the drain outlet; the plunger union tab engages the plunger tab via a torsional spring, wherein the plunger union tab is configured to move the torsional spring such that the torsional spring moves the plunger tab; and/or a torsional spring positioned about the plunger union, wherein the plunger union comprises a torsional flange and a torsional plate, wherein the torsional plate is fixed to the plunger union and the torsional plate is configured to rotate relative to the plunger union, the torsional plate connected to the plunger union tab, wherein the torsional spring interfaces between the torsional flange and the torsional plate such that rotation of the torsional flange via the plunger union rotating causes rotation of the plunger plate to rotate the plunger union tab.

In some embodiments, a drain fitting device can include one or more of the following: a drain inlet and a drain outlet, wherein a drain periphery extends between the drain inlet and the drain outlet to define a chamber that is configured to direct fluid from the drain inlet to the drain outlet; a claw positioned within the chamber, the claw being configured to rotate in a first direction to push a stopper into an open position that allows fluid to flow through the drain inlet, and wherein the claw is configured to rotate in a second direction such that the claw does not interact with the stopper, enabling the stopper to be in a closed position that prevents flow of fluid through the drain inlet; a plunger rotatably coupled to the claw, the plunger comprising a plunger tab that is configured to interface with a cable of a handle lever such that rotating the handle lever manipulates the cable to cause the plunger to rotate, resulting in the claw rotating in the first direction or the second direction; a plunger union that interfaces with the plunger, the plunger union comprising a union tab that is configured to engage the plunger tab such that the plunger rotates with the plunger union, and wherein the plunger union is configured to rotate to a disengaged position in which the union tab is not engaging the plunger tab, enabling the plunger to rotate freely relative to the plunger union; and/or an actuator configured to rotate the plunger union, wherein the rotation of the plunger union engages the union tab with the plunger tab causing the plunger to rotate such that the claw is rotated in the first direction so that the stopper is pushed into an open position, allowing fluid to flow through the drain inlet.

In some embodiments, the drain fitting device can further include the actuator comprising at least one of an electric motor, a solenoid, a thermal motor, or a cable assembly.

In some embodiments, a drain fitting can include one or more of the following: a drain inlet and a drain outlet, wherein a drain periphery extends between the drain inlet and the drain outlet to define a chamber, the chamber being configured to direct fluid from the drain inlet to the drain outlet; a cam positioned within the chamber, the cam being configured to rotate in a first direction such that the cam pushes a stopper into an open position that allows fluid to flow through the drain inlet, and wherein the cam is configured to rotate in a second direction such that the cam does not engage the stopper, enabling the stopper to be in a closed position that prevents fluid to flow through the drain inlet; a plunger rotatably coupled to the cam, the plunger comprising a first tab configured to rotate the cam in the first direction or the second direction; and/or a plunger union that interfaces with the plunger, the plunger union comprising a second tab that is configured to engage first tab of the plunger to rotate the plunger as plunger union is rotated, and wherein the plunger union is configured to rotate to a disengaged position in which the second tab is not engaging the first tab of the plunger to allow the plunger to rotate relative to the plunger union.

In some embodiments, the drain fitting can further include one or more of the following: the plunger union comprises a cylindrical body configured to rotate about a central axis of the plunger and the plunger union; the second tab extends along the cylindrical body parallel to the central axis; the first tab extends from the plunger perpendicular to the central axis; the plunger comprises an aperture centered on the central axis, wherein a portion of the plunger union is configured to extend into the aperture; the second tab is configured to extend along the central axis along an outer surface of the plunger with the portion of the plunger in the aperture; the first tab extends from the outer surface of the plunger at a position to engage the second tab about the central axis with the portion of the plunger union in the aperture of the plunger; a surface of the portion of the plunger union is at a first radius from the central axis, a surface of the aperture is at a second radius from the central axis, a surface of the plunger is at a third radius from the central axis, and a surface of the second tab is at a fourth radius from the central axis, wherein the first radius is smaller than the second radius, the second radius is smaller than the third radius, and the third radius is smaller than the fourth radius; the second tab extends a length that is less than a length of the portion of the plunger union; the second tab is offset from the portion of the plunger union; the plunger union comprises a first portion that comprises a pair of flat engagement surfaces with a pair of curved engagement surfaces extending therebetween, and wherein the first portion is configured to interface with a motor configured to rotate the plunger union; the drain fitting further comprising: a housing within with which the plunger and plunger union are at least partially positioned; and a housing cover that is configured to couple to the housing, wherein the housing cover comprises a cavity to receive the plunger union, and wherein the first portion of the plunger union extends through the housing cover; the cavity extends through the housing cover, wherein a panel covers at least a portion of an opening of the cavity, and wherein the first portion of the plunger union extends through a hole in the panel; the cavity is at least partially positioned within a cylindrical extrusion of the housing cover, and wherein the drain periphery of the cylindrical extrusion includes threads that are configured to facilitate a connection with a motor configured to rotate the plunger union; the second tab moves the first tab via a spring, wherein the second tab is configured to move the spring such that the spring moves the first tab; and/or a spring positioned on the plunger union, wherein the plunger union comprises a torsional flange and a torsional plate, wherein the torsional plate is fixed to the plunger union and the torsional plate is configured to rotate relative to the plunger union, the torsional plate connected to the second tab, wherein the spring interfaces between the torsional flange and the torsional plate such that movement of the torsional flange via the plunger union moving causes movement of the plunger plate to move the second tab.

Methods of using the foregoing system(s) (including device(s), apparatus(es), assembly(ies), structure(s), and/or the like) are included; the methods of use can include using or assembling any one or more of the features disclosed herein to achieve functions and/or features of the system(s) as discussed in this disclosure. Methods of manufacturing the foregoing system(s) are included; the methods of manufacture can include providing, making, connecting, assembling, and/or installing any one or more of the features of the system(s) disclosed herein to achieve functions and/or features of the system(s) as discussed in this disclosure.

The Summary is provided to introduce a selection of concepts in a simplified form that are further described below in the Detailed Description. This Summary is not intended to identify key features or essential features of any subject matter described herein.

BRIEF DESCRIPTION OF THE DRAWINGS

Various embodiments are depicted in the accompanying drawings for illustrative purposes and may not be drawn to scale, and should in no way be interpreted as limiting the scope of the embodiments. In addition, various features of different disclosed embodiments can be combined to form additional embodiments, which are part of this disclosure. In the drawings, similar elements may have reference numerals with the same last two digits.

DETAILED DESCRIPTION

Although certain embodiments and examples are described below, this disclosure extends beyond the specifically disclosed embodiments and/or uses and obvious modifications and equivalents thereof. Thus, it is intended that the scope of this disclosure should not be limited by any particular embodiments described below. Furthermore, this disclosure describes many embodiments in reference to bathing environments but any embodiment and modifications or equivalents thereof should not be limited to bathing environments. In addition, various features of different disclosed embodiments can be combined to form additional embodiments, which are part of this disclosure.

Figure 1A:
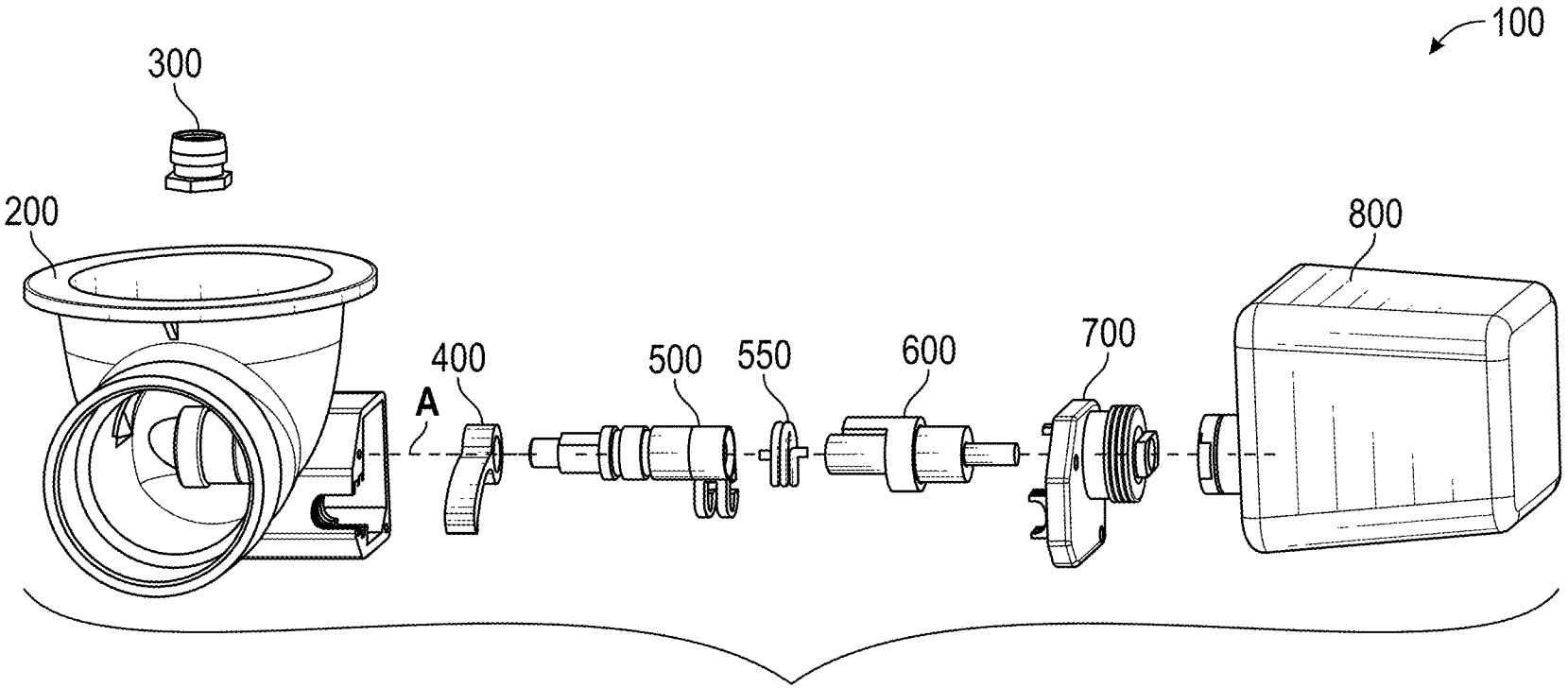
FIG. 1A illustrates an exploded view of an embodiment of a drain fitting device.

FIG. 1A illustrates an exploded view of a drain fitting device or assembly 100. The drain fitting device 100 can be implemented in a bathing environment, such as a walk-in tub, standard tub, soaking tubs, whirlpool tub, shower, or other bathing system, including bath tubs, to facilitate the retention or drainage of fluid in or from the bathing environment. The drain fitting device 100 can include a drain fitting 200, bushing 300, stopper 310, cam or claw 400, plunger 500, a torsional spring 550, plunger union 600, housing cover 700, and/or motor 800. As discussed herein, various components can rotate along a rotation axis A illustrated in FIG. 1A to rotate the cam or claw 400 about rotation axis A.

Figure 1B:
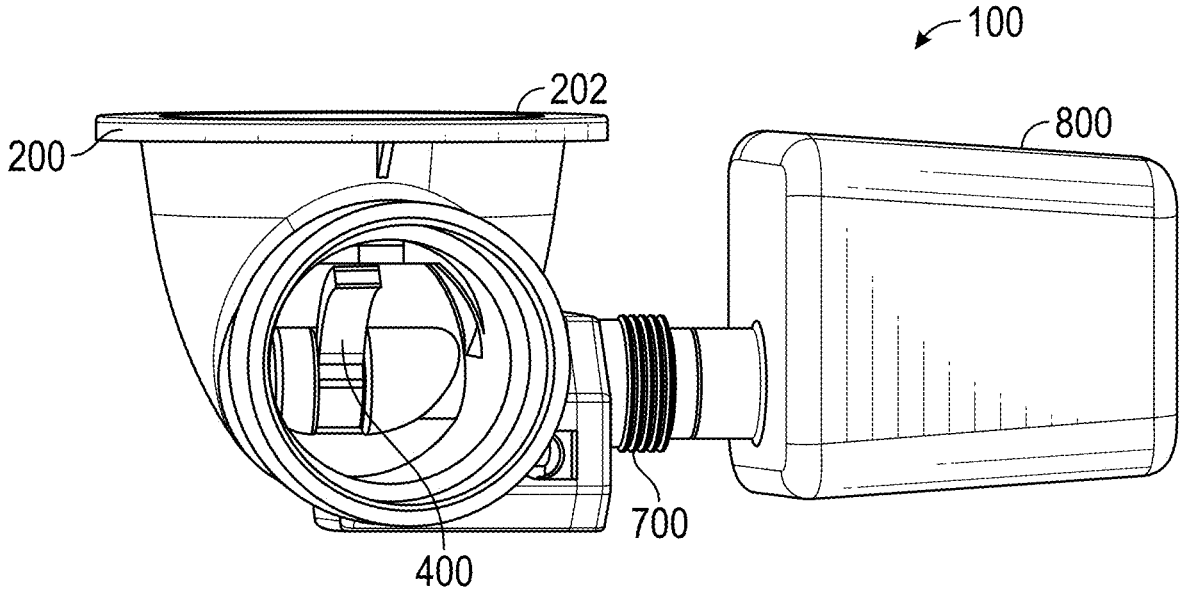
FIG. 1B illustrates the drain fitting device of FIG. 1A assembled and with the cam rotated to a first position that pushes a stopper to an open position, allowing the flow of fluid through the drain inlet.
Figure 1C:
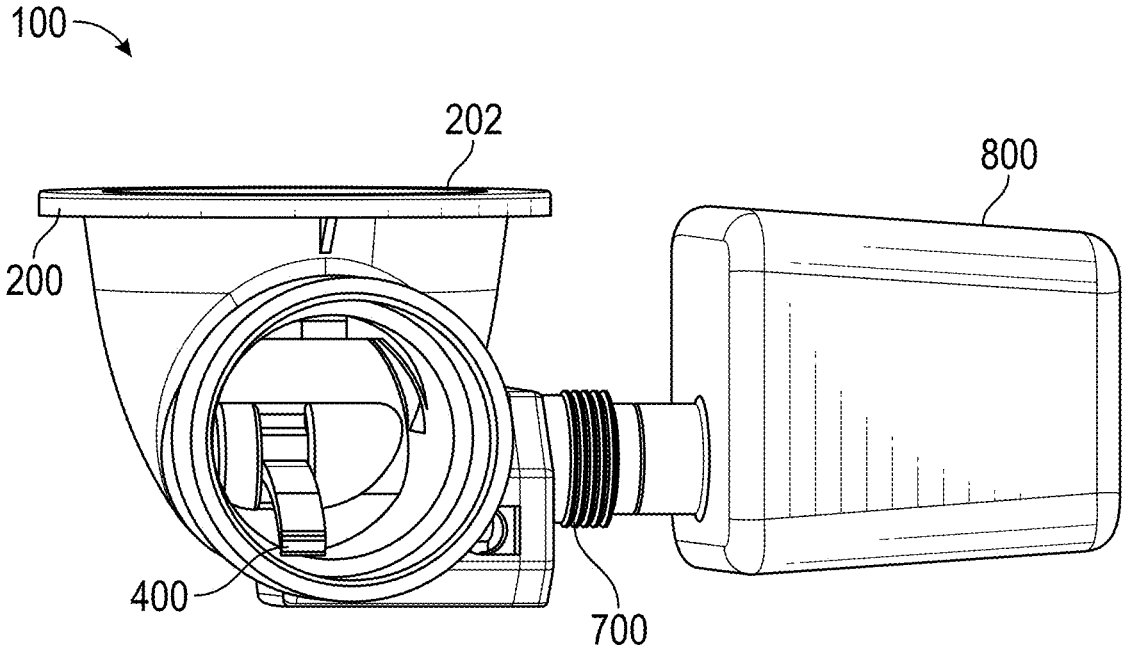
FIG. 1C illustrates the drain fitting device of FIG. 1A assembled and with a cam rotated to a second position that enables a stopper to be in a closed position, preventing the flow of fluid through a drain inlet.

When assembled (such as along rotation axis A), as shown in FIGS. 1B and 1C, the cam or claw 400 is positioned within the drain fitting 200. A stopper 310 can be placed at or proximate a drain inlet 202 of the drain fitting 200. The stopper 310 can be configured to plug or unplug the drain inlet 202, obstructing or allowing the flow of fluid through the drain inlet 202, which can result in the draining of a bathing environment. The cam 400 can be positioned under the stopper 310 such that rotation of the cam 400 (about rotation axis A) results in movement of the stopper 310. For example, the motor 800, housing cover 700, plunger union 600, and plunger 500 can cooperate together along rotation axis A, as is explained in more detail herein, to rotate the cam 400 about rotation axis A.

As shown in FIG. 1B, the motor 800 can rotate the cam 400 in a first direction to place the cam 400 in a raised configuration. Moving the cam 400 in the first direction can interface the cam 400 with the stopper 310 to push the stopper 310 into an open position, unplugging the drain inlet 202 to allow fluid to flow through the drain inlet 202 of the drain fitting 100. As shown in FIG. 1C, the motor 800 can rotate the cam 400 in a second direction to place the cam 400 in a lowered configuration. Moving the cam 400 in the second direction can place the cam 400 such that the cam 400 does not interact with the stopper 310, which can enable the stopper 310 to be placed in a closed position that prevents the flow of fluid through the drain inlet 202.

In some aspects, a user can push a button, flip a switch, or interact with another suitable user interface to instruct the motor 800 to rotate the cam 400 in the first direction or the second direction. In some aspects, the motor 800 can be instructed to move the cam 400 in the first direction or second direction to various intermediate positions and/or along a continuum of positions. In the descriptions above and described herein, the motor 800 is described as rotating the cam 400 to actuate the stopper 310 but this should not be limiting. One of ordinary skill in the art will recognize that, in some embodiments, other mechanical or electrical mechanisms can be used to rotate the cam 400. The cam 400, in some aspects, can be rotated with a lever/handle and cable system. Accordingly, the motor 800 actuating the cam 400, as described above, can be advantageous in the event that the lever/handle breaks, lever/handle falls off, and/or cable snaps and a user needs to drain a bathing environment. Further, enabling a user to rotate the cam 400 with the push of a button or using a similar user interface can make it easier to drain a bathing environment, especially when a lever/handle is wet or the user is impaired.

Figure 2A:
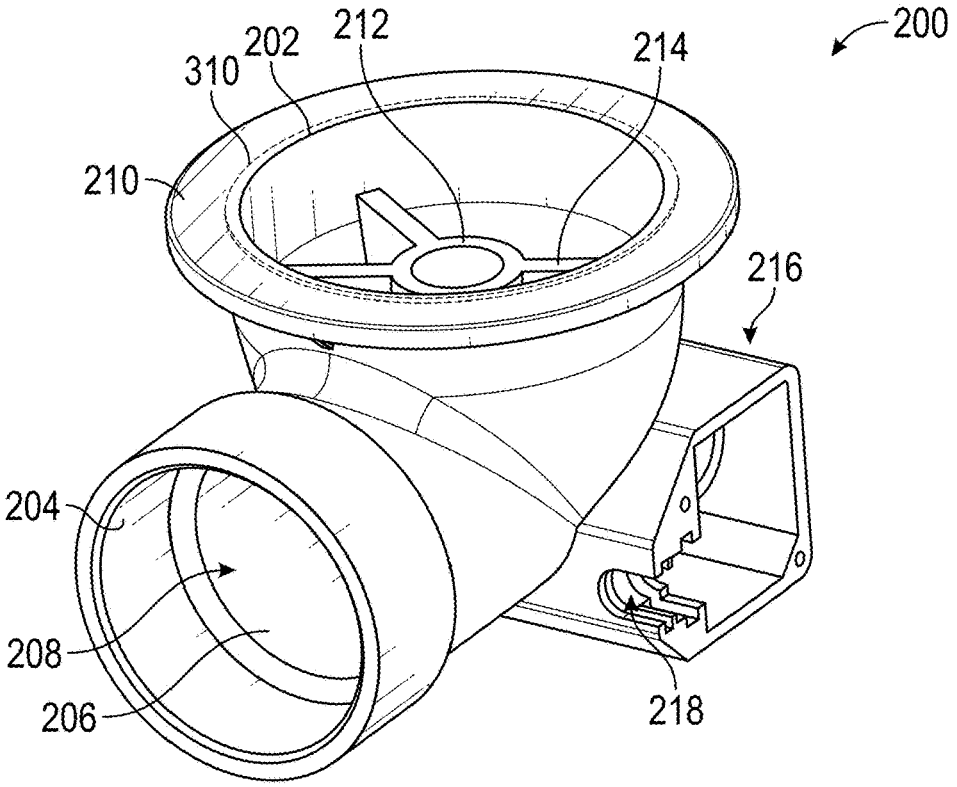
FIG. 2A illustrates a perspective view of an embodiment of a drain fitting.
Figure 2B:
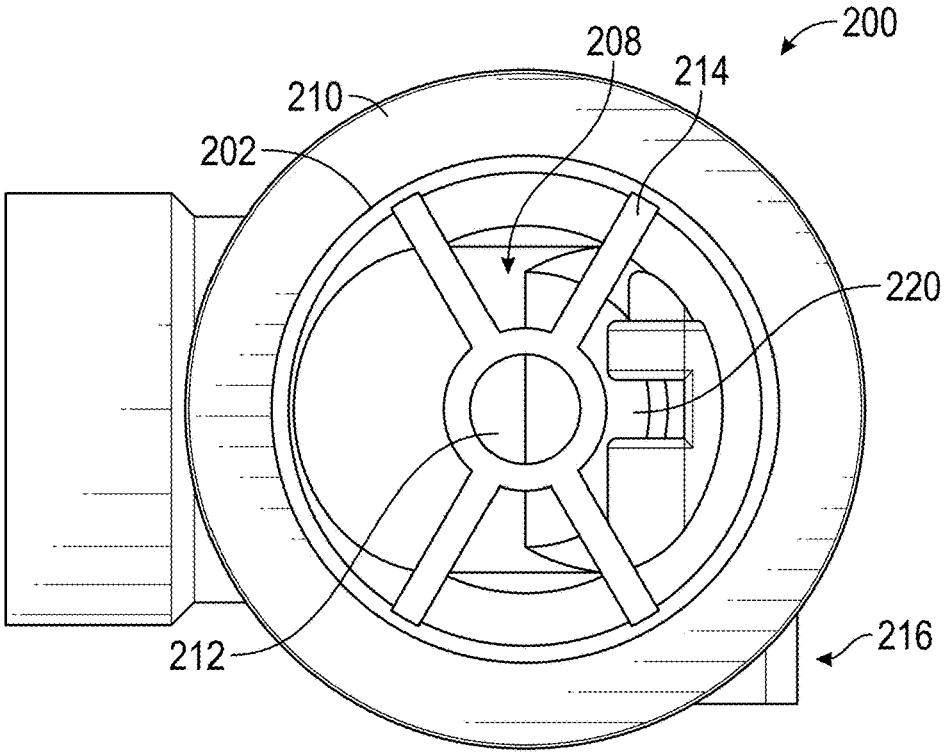
FIG. 2B illustrates a top view of the drain fitting of FIG. 2A.
Figure 2C:
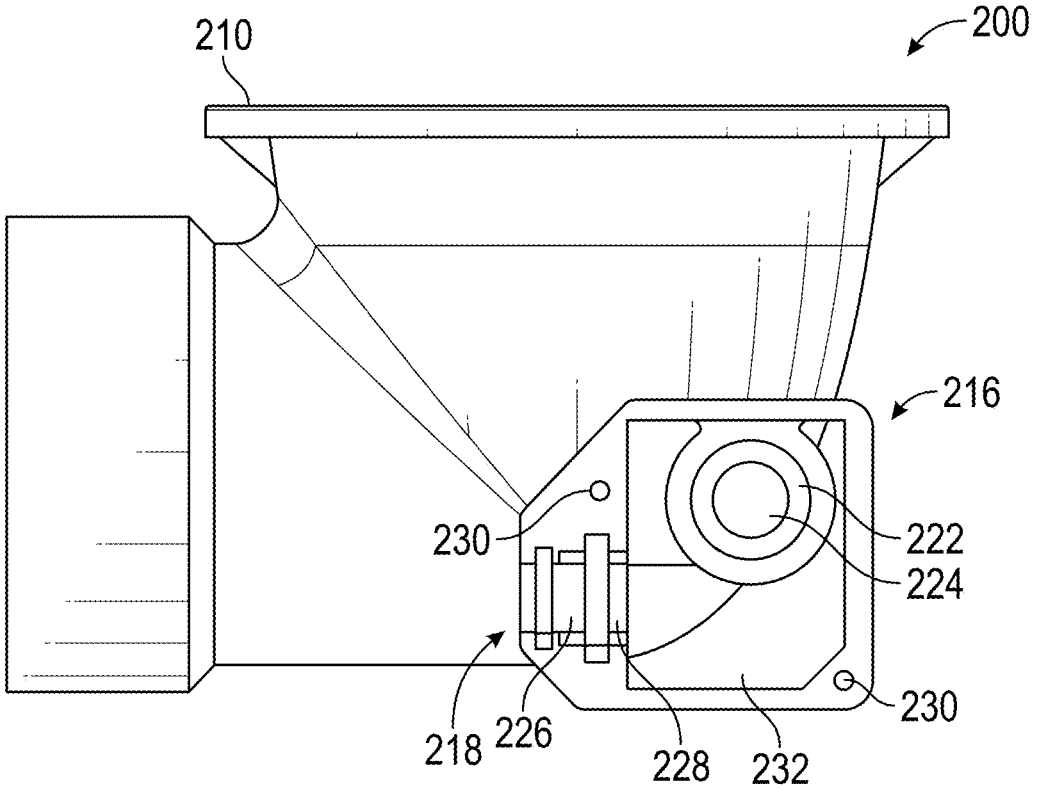
FIG. 2C illustrates a side view of the drain fitting of FIG. 2A.

FIGS. 2A-2C illustrate various views of the drain fitting 200. As shown in FIG. 2A, the drain fitting 200 has a drain inlet 202 and a drain outlet 204. In some aspects, the drain inlet 202 can be larger than the drain outlet 204. A drain periphery 206 can extend between the drain inlet 202 and the drain outlet 204 to define a chamber 208 that can direct fluid from the drain inlet 202 to the drain outlet 204. A flange 210 can surround the drain inlet 202. When installed in a bathing environment, the drain inlet 202 can be positioned at a drain aperture of the bathing environment, such that a bottom surface of the flange 210 interfaces with a surface of the bathing environment surrounding the drain aperture, and the drain outlet 204 can be coupled to piping that directs fluid away from the bathing environment.

As illustrated in FIG. 2A, the drain inlet 202 can interface, mate, and/or connect with a stopper 310. The stopper 310 can be moved by the cam 400 as discussed herein. For example, the stopper 310 can interface with a lever 408 of the cam 400 to be moved by the lever 408 as discussed herein. The stopper 310 can have an extension, rod, or stem that extends through a bushing 300 to contact the lever 408. The extension, rod, or stem of the stopper 310 may be in a non-fixed contact with the lever 408 that can disengage from contact with the lever 408 when the lever 408 is rotated or moved away from the stopper 310 as discussed herein, while allowing the lever 408 to push up on the stopper 310 (including the rod of the stopper 310) via direct contact to move the stopper 310 vertically up to open the drain inlet 202 as discussed herein as the lever 408 is rotated or moved toward the stopper 310.

The drain fitting 200 can have a bushing interface 212 which can be supported by a plurality of supports 214. The bushing interface 212 can have a center axis that is coaxial with a center axis of the drain inlet 202. The bushing interface 212 can receive a bushing 300, described in FIG. 3, that couples to the stopper 310. The drain fitting 200 can include a housing 216 within which the plunger 500 and plunger union 600 can be at least partially enclosed. The housing 216 can include an access aperture 218 through which a cable can be routed.

As shown in FIG. 2B, the housing 216 can extend into the chamber 208 and can include a cam aperture 220. The cam aperture 220 can, as illustrated in FIGS. 1B and 1C, enable the cam 400 to rotate to different positions while being coupled to the plunger 500. As illustrated in FIG. 2C, the housing 216 of the drain fitting 200 can define a cavity 232 within which the plunger 500 and plunger union 600 can be stored. The housing 216 can include a first socket 222 and a second socket 224 that can receive the plunger 500. The first socket 222 and/or second socket 224 can be the portion of the housing 216 that extends into the chamber, as seen in FIG. 2B. The first socket 222 and/or second socket 224 can each define cylindrical cavities. The first socket 222 can define a cylindrical cavity that has a larger diameter than that of the second socket 224.

The cam aperture 220, described in reference to FIG. 2B, can extend into the first socket 222 such that the cam 400 can couple to the plunger 500. Returning to FIG. 2C, the housing 216 can include a first housing flange 226 and a second housing flange 228. The first housing flange 226 and the second housing flange 226 can form a portion of the periphery of the access aperture 218. The housing 216 can include a plurality of coupling holes 230 that can be used to couple the housing 216 to the housing cover 700.

Figure 3A:
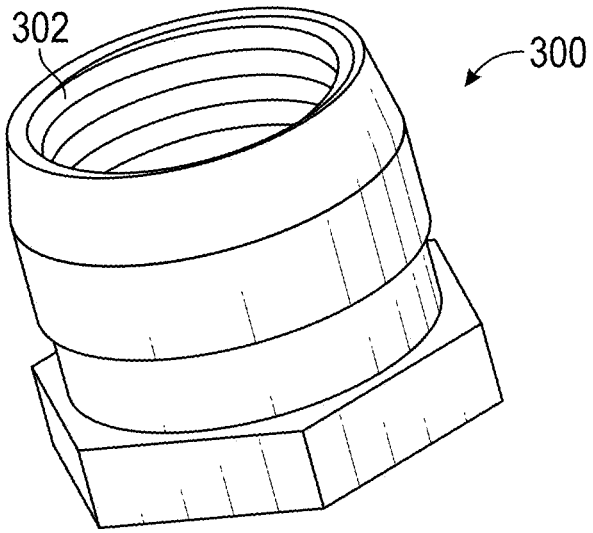
FIG. 3A illustrates an embodiment of a bushing.

FIG. 3A illustrates the bushing 300. As described above, the bushing 300 can be received by the bushing interface 212, which can include the bushing 300 being coupled to the bushing interface 212 with a press fit, snap fit, threaded connection, or other suitable connection. The bushing 300 can couple to the stopper 310 such that the stopper 310 remains positioned proximate the drain inlet 202. The bushing 300 can have internal threads 302 that couple to external threads of the stopper 310. In some aspects, the stopper 310 can be spring actuated. Upon application of a downward force, the stopper 310 can be locked in a down position, plugging the drain inlet 202. Upon a subsequent application of a downward force, the stopper 310 can be released and spring up, unplugging the drain inlet 202.

Figure 3B:
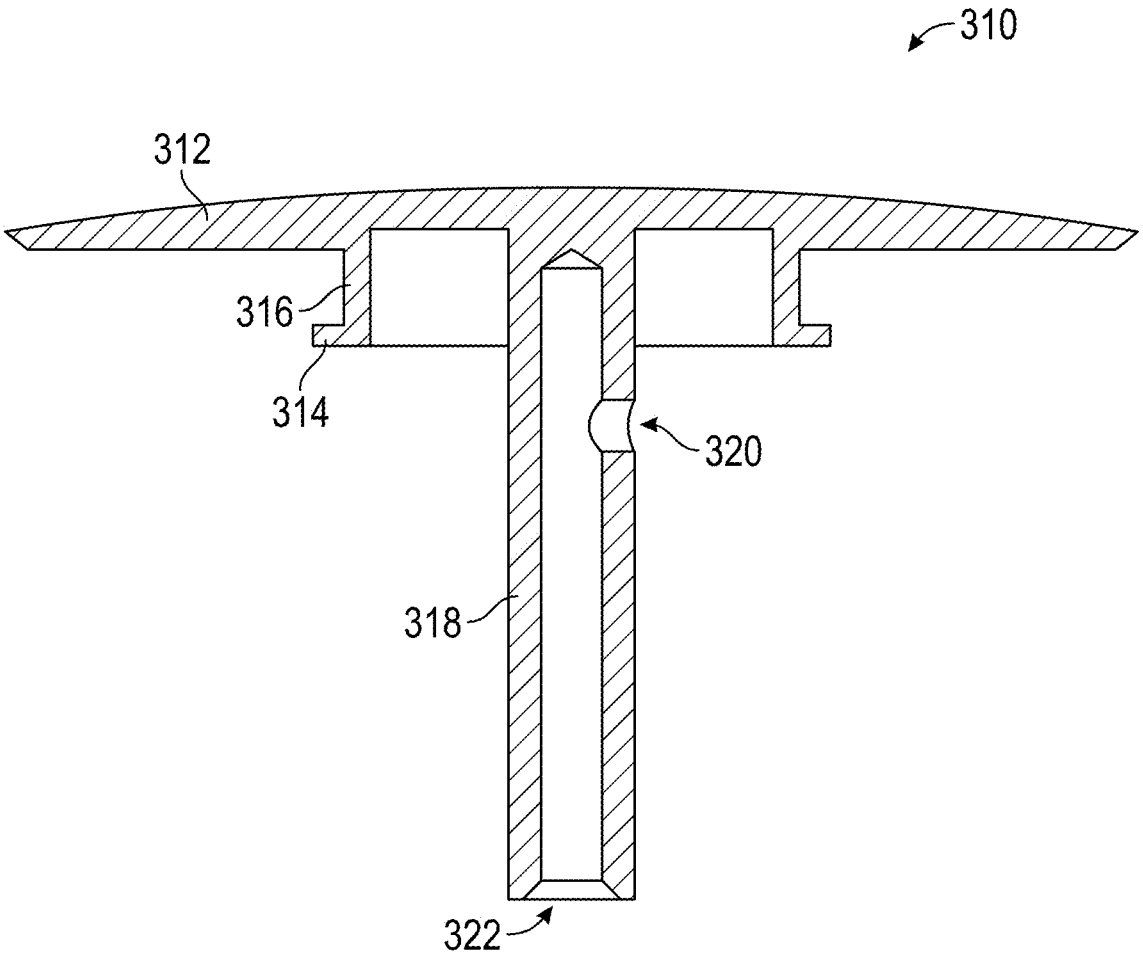
FIG. 3B illustrates an embodiment of a stopper.

FIG. 3B illustrates a stopper 310. The stopper 310 can have a head or cap 312. The cap 312 can be connected to a flange 314 via a cylindrical body 316. The cylindrical body 316 can couple, mate, and/or engage with a gasket that is positioned between the cap 312 and the flange 314. The gasket can engage, rest against, or be positioned on a surface of the drain inlet 202, including the flange 210, surface of the flange 210, or annular inner surface of the drain inlet 202, to inhibit or prevent the flow of fluid through the drain inlet 202. The cap 312 may also engage, rest against, or be positioned on a surface of the drain inlet 202, including the flange 210 or surface of the flange 210, to inhibit or prevent the flow of fluid through the drain inlet 202. The stopper 310 can have an extension, rod, or stem 318 connected to the cap 312. The stem 318 can extend through the bushing interface 212 and engage to function with the busing 300 as discussed herein.

The stem 318 can have a first or manual opening 320 for manually manipulating the stopper 310 via a lever, rod, or other mechanism by a user. The stem have a second or height adjustment opening 322. The second opening 322 can be threaded to engage or connect to a bolt or some other threaded component that can extend downwardly or away from the second opening 322. The bolt can be threaded into the second opening 322 to adjust the height of the stopper 310, and in particular the cap 312, protruding upward or away from the upper surface of the flange 210 when assembled. The bolt can interface or be pushed by the cam 400, and in turn, push the stopper 310 as discussed herein.

Figure 4A:
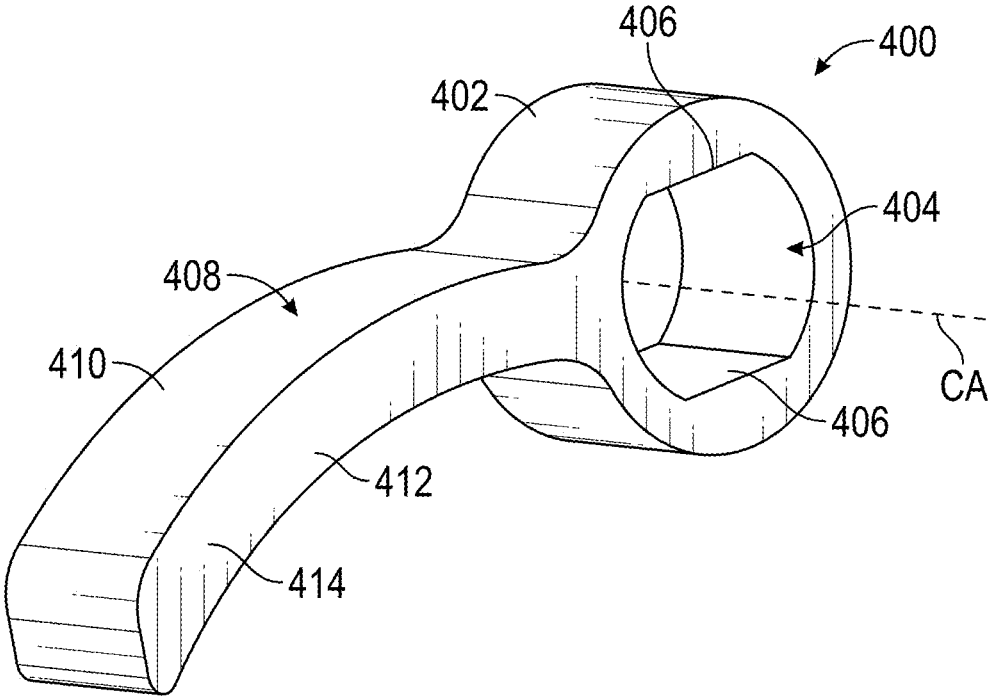
FIG. 4A illustrates a perspective view of an embodiment of a cam or claw.
Figure 4B:
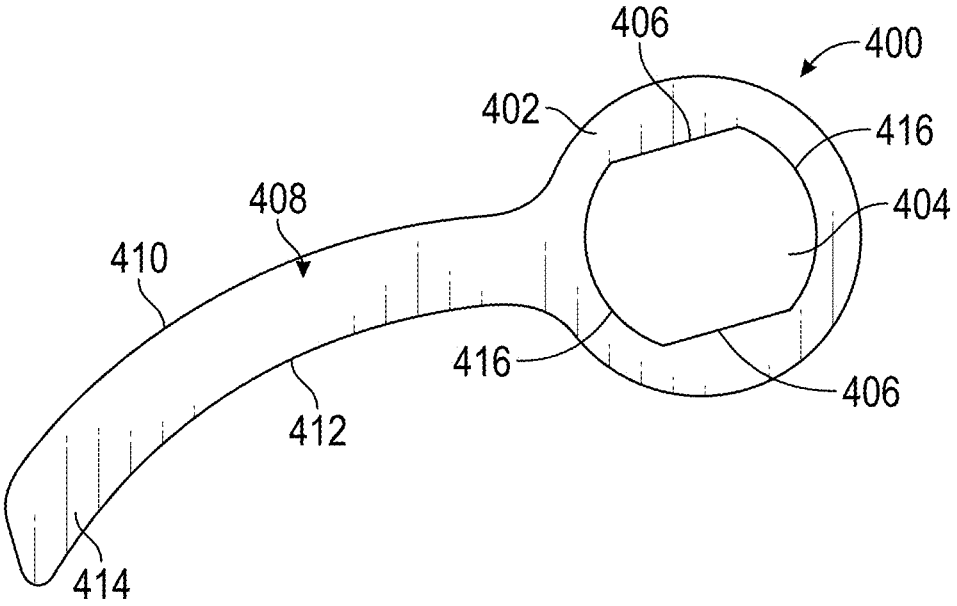
FIG. 4B illustrates a side view of the cam or claw of FIG. 4A.

FIGS. 4A and 4B illustrate various views of the cam or claw 400. The cam 400 can include a cam main body 402. The cam main body 402 can be cylindrical or generally cylindrical. The cam 400 can have a plunger-receiving aperture 404 that can extend through the cam main body 402. The plunger-receiving aperture 404 can include a pair of flat engagement surfaces 406 and, as shown in FIG. 4B, a pair of curved engagement surfaces 416. The pair of flat engagement surfaces 406 can be parallel to each other. The pair of flat engagement surfaces 406 can ensure that the cam 400 rotates with the plunger 500 when coupled together. In some aspects, other surface features can be used to ensure rotational coupling, such as grooves, teeth, or other suitable features.

The cam 400 can include a lever 408, also referred to as an elongate structure and/or bar. The lever 408 can extend away from the cam main body 402. The lever 408 can include a top lever surface 410 and a bottom lever surface 412. The top lever surface 410 and/or the bottom lever surface 412 can be curved, which can include being curved around an axis or axes that are parallel to a central axis CA of the cam main body 402 or plunger-receiving aperture 404. The central axis CA of the cam main body 402 can correspond to and extend/be along the rotation axis A with the drain fitting device 100 assembled. A pair of parallel flat surfaces 414 can extend between the top lever surface 410 and the bottom lever surface 412. As described above, the cam 400 can be rotated to push a stopper 310, enabling fluid to flow through the drain inlet 202 of the drain fitting 200. In some aspects, the top lever surface 410 engages with the stopper 310. In some aspects, the cam 400 may not be fixed to the stopper 310. Instead, the cam 400 rotates to push the stopper 310 with a top lever surface 410. This can advantageously reduce the risk that the drain fitting device 100 will break if a user steps onto the stopper 310 when the cam 400 is rotated up and engaged with the stopper 310 in an open position.

Figure 5A:
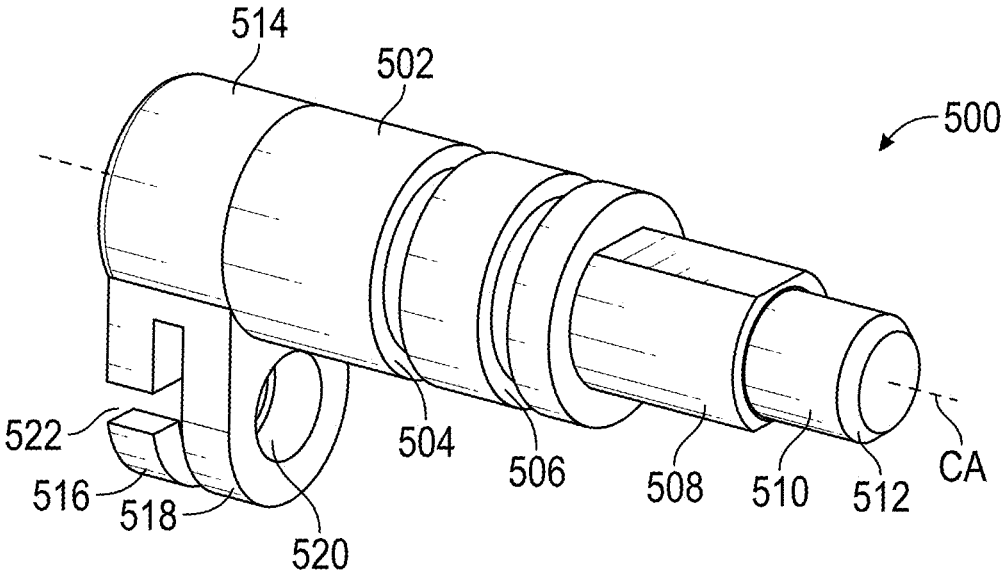
FIG. 5A illustrates a first perspective view of an embodiment of a plunger.
Figure 5B:
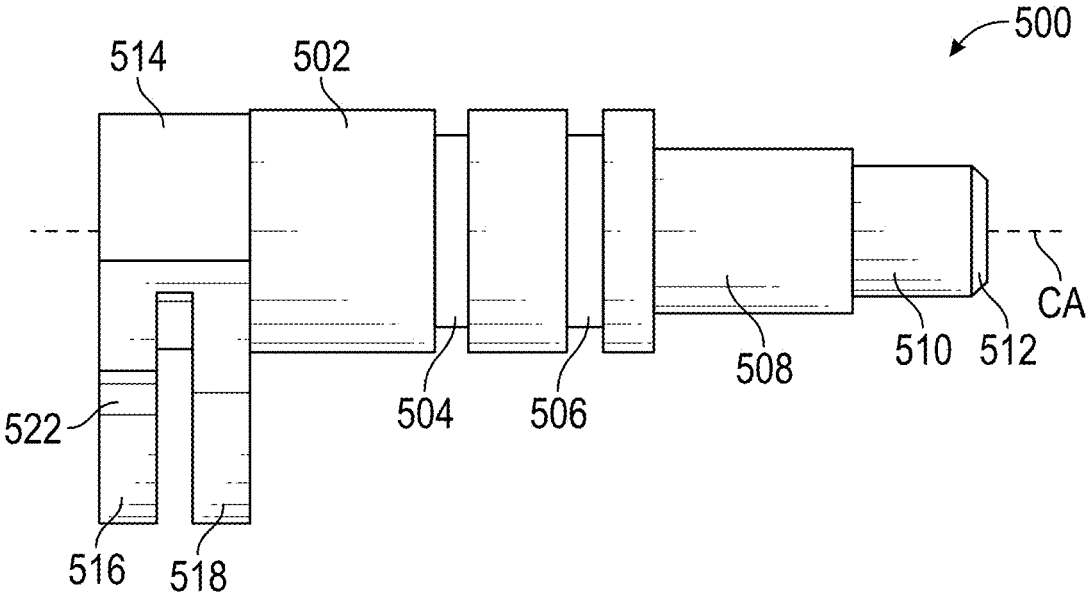
FIG. 5B illustrates a side view of the plunger of FIG. 5A.

FIGS. 5A-5E illustrate various views of the plunger 500. As shown in FIGS. 5A and 5B, the plunger 500 can include a main cylindrical portion 502. The main cylindrical portion 502 can have a first groove 504 and/or a second groove 506. The first groove 504 and/or the second groove 506 can receive O-rings. The O-rings can prevent fluid from entering the housing 216 of the drain fitting 200 when the drain fitting device 100 is assembled and in use. The O-rings can also facilitate alignment by helping to align the plunger 500 within the housing 216, specifically align the main cylinder portion 502 in the first socket 222 of the housing 216. The O-rings can be particularly beneficial to alignment when the components of the drain fixture device 100 are injection molded. The plunger 500 can include a second cylindrical portion 514, which can be proximate the main cylindrical portion 502. In some aspects, the second cylindrical portion 514 has a diameter that is smaller than the main cylindrical portion 502.

A first plunger tab 516 and/or a second plunger tab 518 can extend from the second cylindrical portion 514. The first plunger tab 516 and the second plunger tab 518 can be offset from each other. The first plunger tab 516 and the second plunger tab 518 can radially extend from the plunger 500 perpendicular to a central axis CA thereof and/or a central axis of rotation of the plunger 500 and plunger union 600 when assembled. The central axis CA of the plunger 500 can correspond to and extend/be along the rotation axis A with the drain fitting device 100 assembled. The first plunger tab 516 and the second plunger tab 518 can be positioned along the plunger 500 such that they can engage with the tab 608 of the plunger union 600 when the transfer shaft or second portion 610 of the plunger union 600 is positioned within the first receiving aperture 526 and/or second receiving aperture 528 of the plunger 500. The first plunger tab 516 and the second plunger tab 518 can have a hole 520. The first plunger tab 516 can have a slot 522 that extends through a periphery of the first plunger tab 516 to the hole 520. A cable can be coupled to the first plunger tab 516 and/or the second plunger tab 518 by interfacing with the slot 522 and/or hole 520.

The first plunger tab 516 and/or the second plunger tab 518, as explained in more detail below, engage with a tab 608 of the plunger union 600 to cause the plunger 500 to rotate with the plunger union 600. The plunger 500 can have a cam-engagement portion 508 that can be inserted into the plunger-receiving aperture 404 of the cam 400. The cam engagement portion 508 can be positioned proximate the main cylindrical portion 502, which can include being positioned on an opposing side of the main cylindrical portion 502 as the second cylindrical portion 514.

Figure 5C:
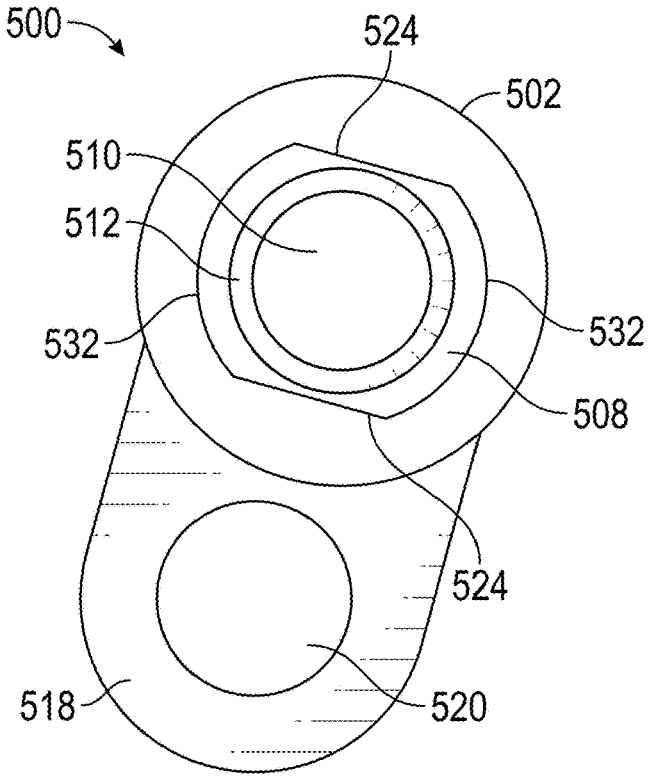
FIG. 5C illustrates a front view of the plunger of FIG. 5A.

As shown in FIG. 5C, the cam-engagement portion 508 can have a pair of flat engagement surfaces 524. A pair of curved engagement surfaces 532 can extend between the pair of flat engagement surfaces 524. The pair of curved engagement surfaces 532 can be curved around a central axis CA of the plunger 500. The pair of flat engagement surfaces 524 can ensure a secure coupling between the cam 400 and the plunger 500. Other surface features can be used to securely couple the plunger 500 and the cam 400. For example, the cam-engagement portion 508 and the cam 400 can have male-female corresponding components to securely couple, including the cam-engagement portion 508 having a boss, pin, or protrusion and the cam 500 having a corresponding indentation, opening, or cutout, or vice versa.

Returning to FIGS. 5A and 5B, the plunger 500 can have a third cylindrical portion 510. The third cylindrical portion 510 can be proximate the cam-engagement portion 508, which can include being positioned on the opposing side of the cam-engagement portion 508 as the main cylinder portion 502. The third cylindrical portion 510 can have a fillet 512 positioned around an edge of a free end of the third cylindrical portion 510. When inserted into the housing 216 of the drain fitting 200, the third cylindrical portion 510 can be inserted into the second socket 224.

Figure 5D:
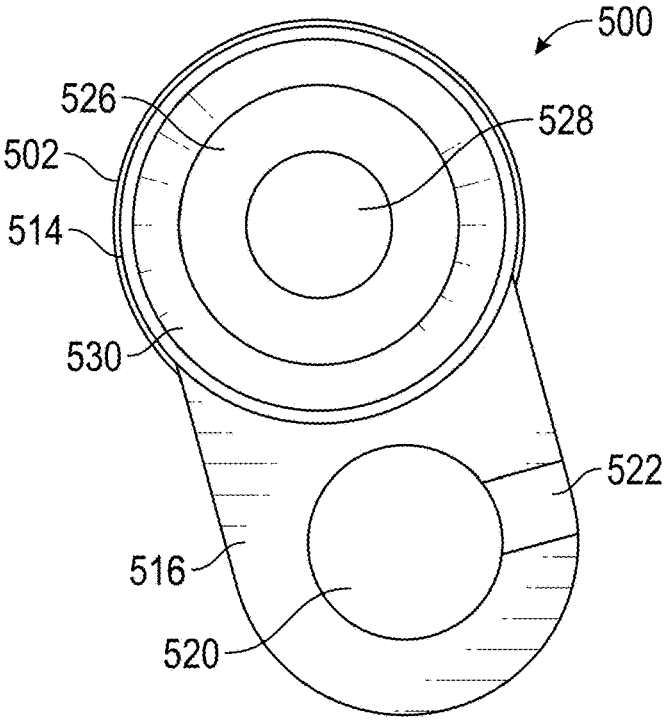
FIG. 5D illustrates a back view of the plunger of FIG. 5A.
Figure 5E:
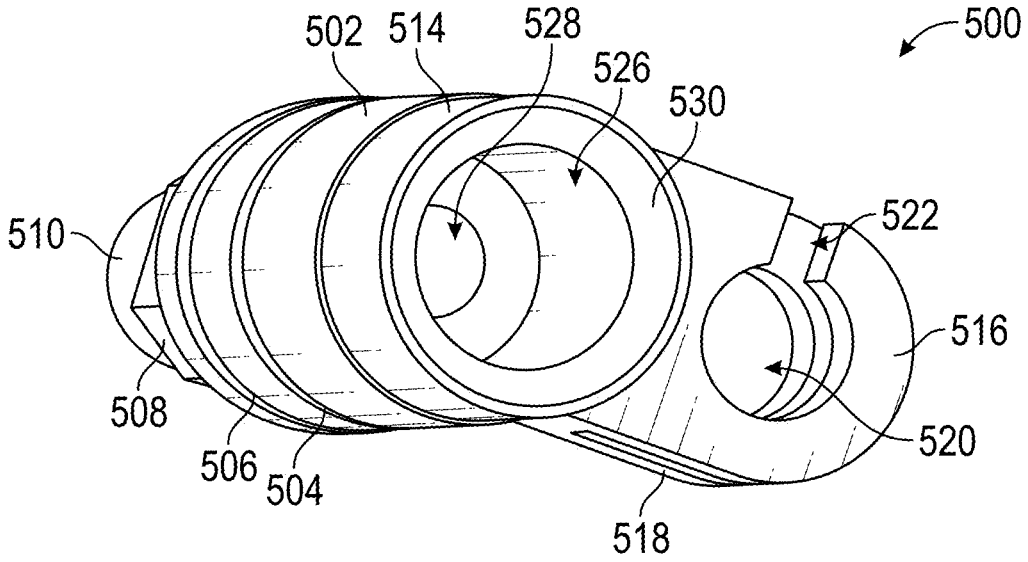
FIG. 5E illustrates a second perspective view of the plunger of FIG. 5A.

As seen in FIGS. 5D and 5E, the plunger 500 can have a first receiving opening, orifice, passage, cutout, divot, slot, cavity, or aperture 526 and/or a second receiving opening, orifice, passage, cutout, divot, slot, cavity, or aperture 528. The first receiving aperture 526 and/or second receiving aperture 528 can be central aperture(s) along the central axis CA. The first receiving aperture 526 and/or second receiving aperture 528 can receive a portion of the plunger union 600, which can include the second portion 610 (described below) of the plunger union 600, such that the plunger union 600 is coupled to the plunger 500. The first receiving aperture 526 and/or second receiving aperture 528 can be centered on a central axis CA of the plunger 500 and/or a central axis of rotation of the plunger 500 and plunger union 600 as assembled. The first receiving aperture 526 and/or second receiving aperture 528 can be round and cylindrical in shape to correspond to the portion(s) of the plunger union 600 to allow for the plunger union 600 to rotate on the rotation axis A relative to the plunger 500 as discussed herein. A chamfer 530 can surround the first receiving aperture 526, which can advantageously guide the second portion 610 of the plunger union 600 into the first receiving aperture 526.

Figure 6A:
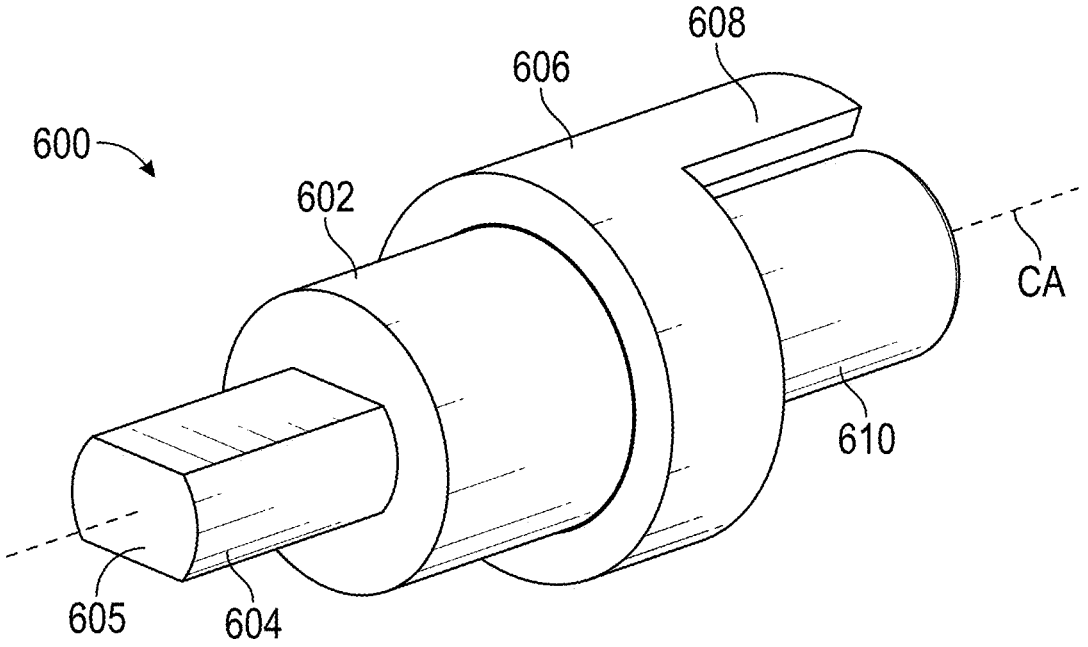
FIG. 6A illustrates a front perspective view of an embodiment of a plunger union.

FIGS. 6A-6J illustrate various views and aspects of the plunger union 600. As illustrated in FIG. 6A, the plunger union 600 can have a cylindrical body. The plunger union 600 can have a first portion 604, second portion 610, third portion 602, and/or fourth portion 606. The first portion 604 can be connected to and extend from the third portion 602 as a projection, extension, or boss. The second portion 610 can be connected to and extend from the fourth portion 606 as a projection, extension, or boss. The first portion 604 can have a surface at a first radius from a central axis CA of the plunger union 600 and/or a central axis of rotation of the plunger 500 and plunger union 600 as assembled. The second portion 610 can have a surface at a second radius from a central axis CA of the plunger union 600 and/or a central axis of rotation of the plunger 500 and plunger union 600 as assembled. The central axis CA of the plunger union 600 can correspond to and extend/be along the rotation axis A with the drain fitting device 100 assembled. The second portion 610 can be cylindrical in shape, which can include having a circular cross-section. The second portion 610 can have a fillet 612 positioned around an edge of a free end of the second portion 610. The second portion 610 can be received by the first receiving aperture 526 and/or the second receiving aperture 528 of the plunger 500, such that the plunger union 600 is rotatably coupled to the plunger 500. The fillet 612 can improve the ease placing the second portion 610 of the plunger union 600 in the first receiving aperture 526 and/or the second receiving aperture 528 of the plunger 500. The fillet 612 can improve the rotation of the second portion 610 within the first receiving aperture 526 and/or the second receiving aperture 528 by reducing the likelihood of binding or inadvertent coupling.

The third portion 602 can have a surface at a third radius from a central axis CA of the plunger union 600 and/or a central axis of rotation of the plunger 500 and plunger union 600 as assembled. The third portion 602 can be cylindrical in shape, which can include having a circular cross-section. The fourth portion 606 can have a surface at a fourth radius from a central axis CA of the plunger union 600 and/or a central axis of rotation of the plunger 500 and plunger union 600 as assembled. The fourth portion 606 can include a portion having a cylindrical shape, which can include having a circular cross-section. The cylindrical part of the fourth portion 606 can correspond to and be positioned on the third portion 602 such as for example, the cylindrical part being a ring that is positioned over or slid onto the third portion 602 at a desired position. The first radius of the first portion 604 can be smaller than the second radius of the second portion 610. The second radius of the second portion 610 can be smaller than the third radius of the third portion 602. The third radius of the third portion 602 can be smaller than the fourth radius of the fourth portion 606.

The first portion 604, second portion 610, third portion 602, and fourth portion 606 can be centered along a central axis CA of the plunger union 600. The first portion 604 can be positioned on a free end of the plunger union 600. The first portion 604 can have a first end 605, defining an end of the plunger union 600. In some aspects, the first end 605 is flat. In some aspects, the first end 605 is curved or rounded. The third portion 602 can be positioned between the first portion 604 and the fourth portion 606. A step can define the transition between the first portion 604 and the third portion 602. The fourth portion 606 can be positioned between the third portion 602 and the second portion 610. A step can define the transition between the third portion 602 and the fourth portion 606. A step can define at least a portion of the transition between the fourth portion 606 and the second portion 610. The second portion 610 can be positioned on a free end of the plunger union 600 that is opposite the first portion 604. The second portion 610 can include a second end 611, defining an end of the plunger union 600 that is opposite the first end. In some aspects, the second end 611 is flat. In some aspects, the second end 611 is curved or rounded.

The fourth portion 606 can include a protrusion, projection, extension, knob, ledge, or tab 608. The plunger union tab 608 can axially extend from the fourth portion 606 and along the cylindrical body of the plunger union 600 parallel to the central axis CA of the plunger union 600 and/or a central axis of rotation of the plunger 500 and the plunger union 600 as assembled. The tab 608 can be curved inward toward or concave relative to a center axis CA of the plunger union 600 and/or a central axis of rotation of the plunger 500 and the plunger union 600 as assembled. The tab 608 can be curved with a center of curvature on the central axis CA of the plunger union 600 and/or a central axis of rotation of the plunger 500 and the plunger union 600 as assembled. The tab 608 can have a curve that includes a radius of curvature corresponding to a curvature of an outer surface of the plunger union 600 and/or the second portion 610 of the plunger union 600. The tab 608 can extend above and parallel to a surface of the second portion 610. The tab 608 can extend in the same direction as the second portion 610. The tab 608 can have a length that is less than that of the second portion 610. In some aspects, the tab 608 can have a length that is equal to or greater than the second portion 610. The tab 608 can have a length that is sufficiently long such that the tab 608 can contact the first plunger tab 516 and/or the second plunger tab 518 when the plunger union 600 is coupled to the plunger 500.

Figure 6B:
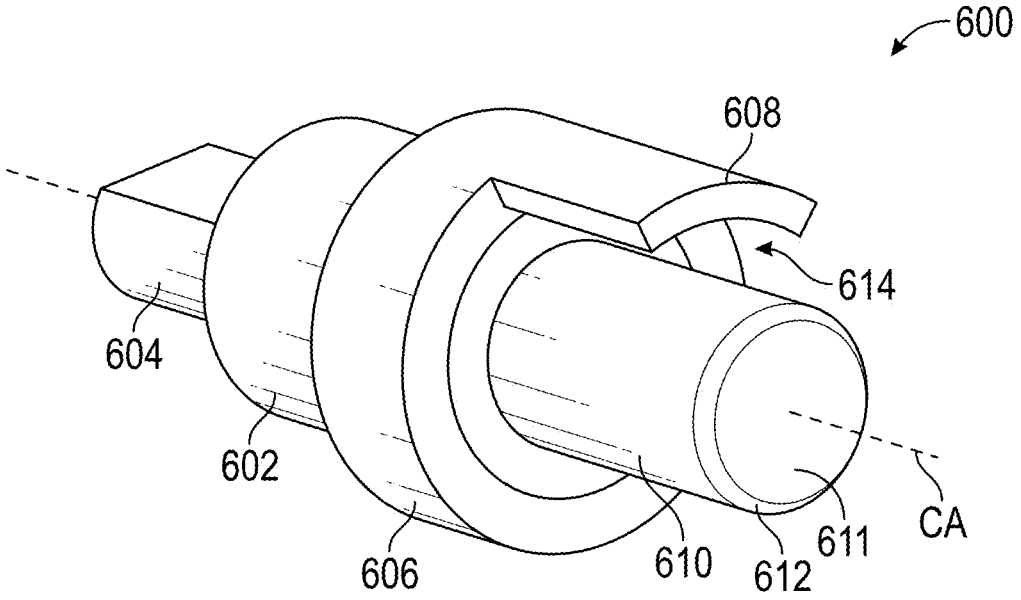
FIG. 6B illustrates a back perspective view of the plunger union of FIG. 6A.
Figure 6C:
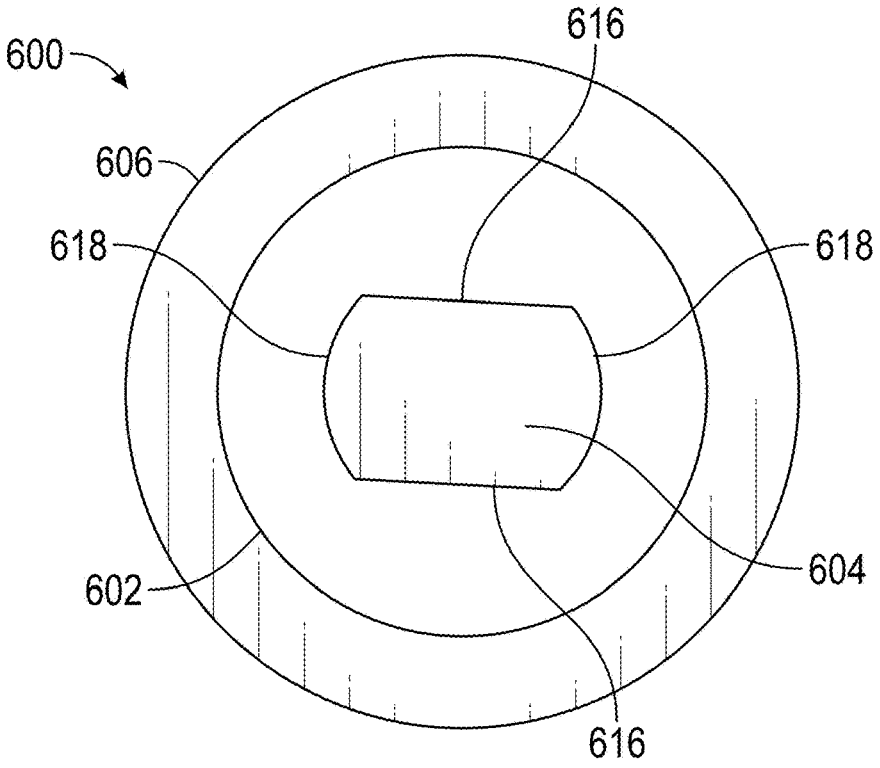
FIG. 6C illustrates a front view of the plunger union of FIG. 6A.
Figure 6D:
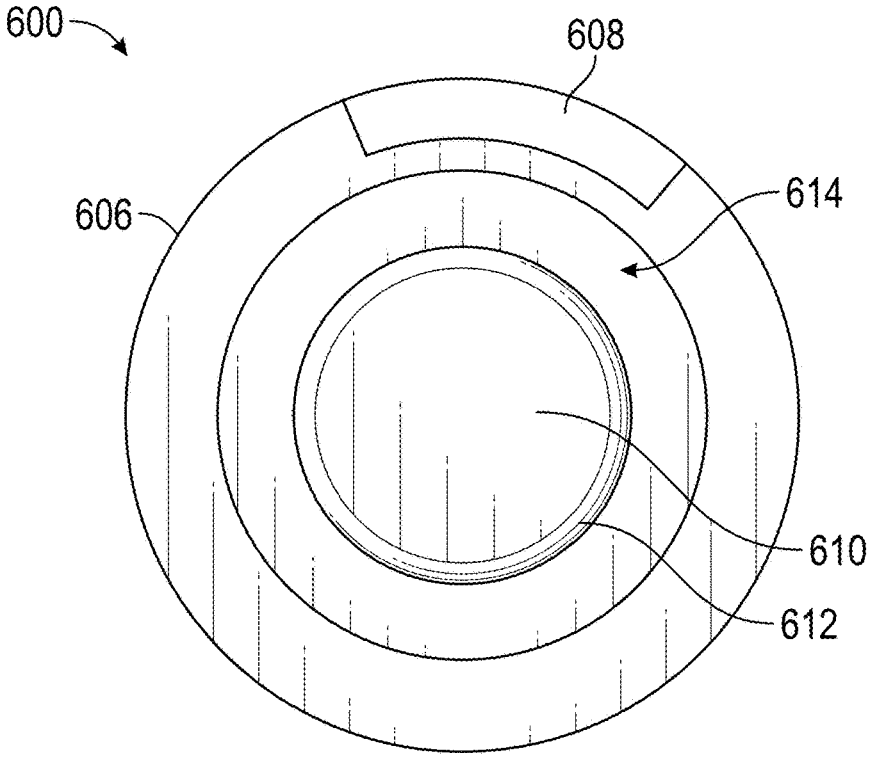
FIG. 6D illustrates a back view of the plunger union of FIG. 6A.

As shown in FIGS. 6B and 6D, the tab 608 can be offset from a surface of the second portion 610 such that a gap 614 extends between the tab 608 and the second portion 610. The gap 614 can be large enough such that the tab 608 is offset from a surface of the plunger 500 when the plunger union 600 is coupled to the plunger 500, which can include positioning the second portion 610 of the plunger union 600 in the first receiving aperture 526 and/or the second receiving aperture 528 of the plunger 500. This can enable the plunger union 600 to rotate independently from the plunger 500. The tab 608 can, however, be rotated to engage the first plunger tab 516 and/or the second plunger tab 518 of the plunger 500. Thus, the plunger union 600 can rotate independently from the plunger 500 until the tab 608 makes contact with the first plunger tab 516 and/or the second plunger tab 518. Once the tab 608 contacts the first plunger tab 516 and/or the second plunger tab 518, the rotation of the plunger union 600 can result in rotation of the plunger 500.

The first portion 604 can be coupled to a motor 800 (described below) such that the plunger union 600 can be rotated by the motor 800. As shown in FIG. 6C, the first portion 604 can include a pair of flat engagement surfaces 616. The pair of flat engagement surfaces 616 can be parallel to each other. A pair of curved engagement surfaces 618 can extend between the pair of flat engagement surfaces 616. The pair of flat engagement surfaces 616 can ensure that the motor 800 rotates the plunger union 600 without slipping. Other surface features such as grooves, teeth, or other suitable features can be used to ensure a secure coupling.

Figure 6E:
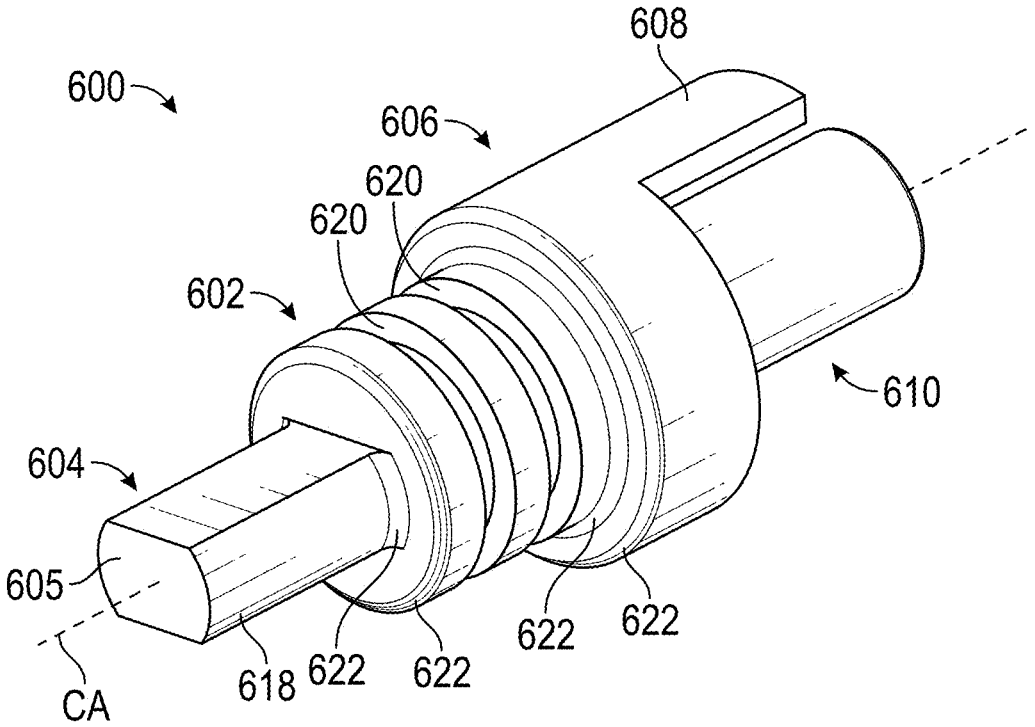
FIG. 6E illustrates a front perspective view of the plunger union of FIG. 6A with fillets and grooves that can receive O-rings.
Figure 6F:
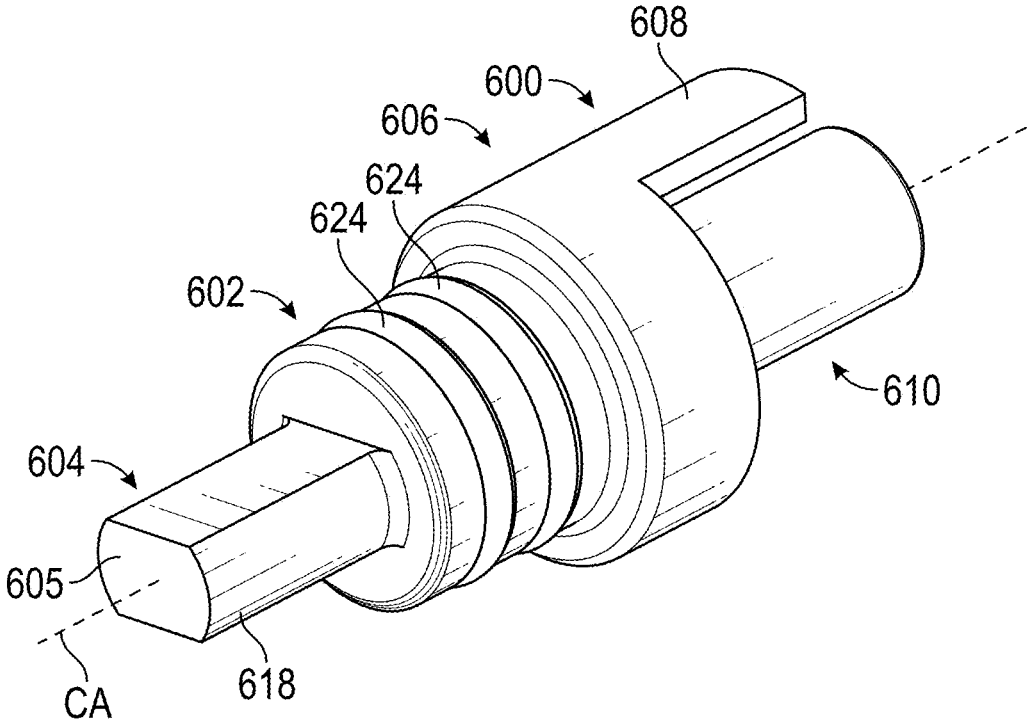
FIG. 6F illustrates a front perspective view of the plunger union of FIG. 6E with O-rings positioned in the grooves.
Figure 6G:
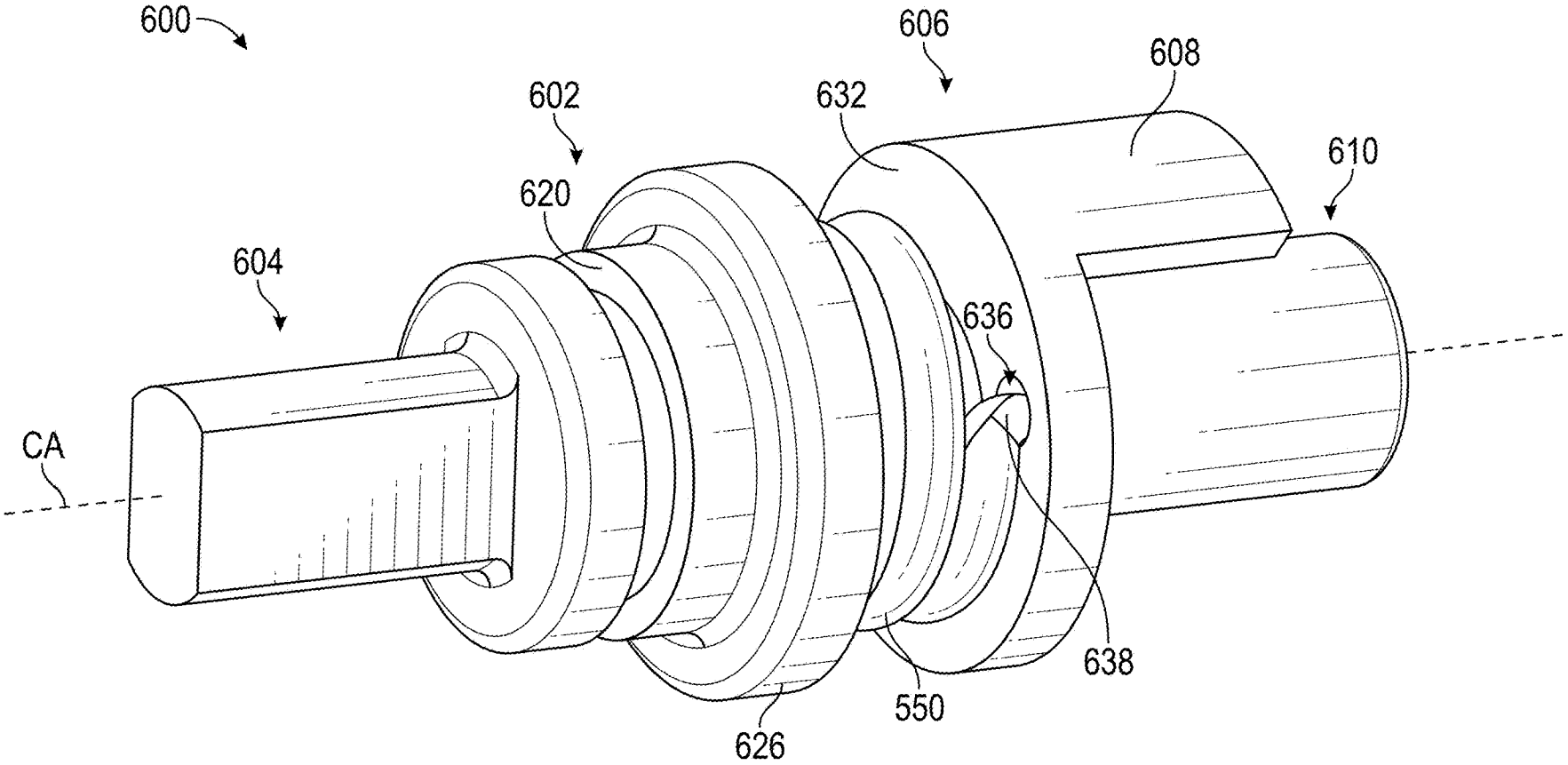
FIG. 6G illustrates a front perspective view of an embodiment of a plunger union.
Figure 6H:
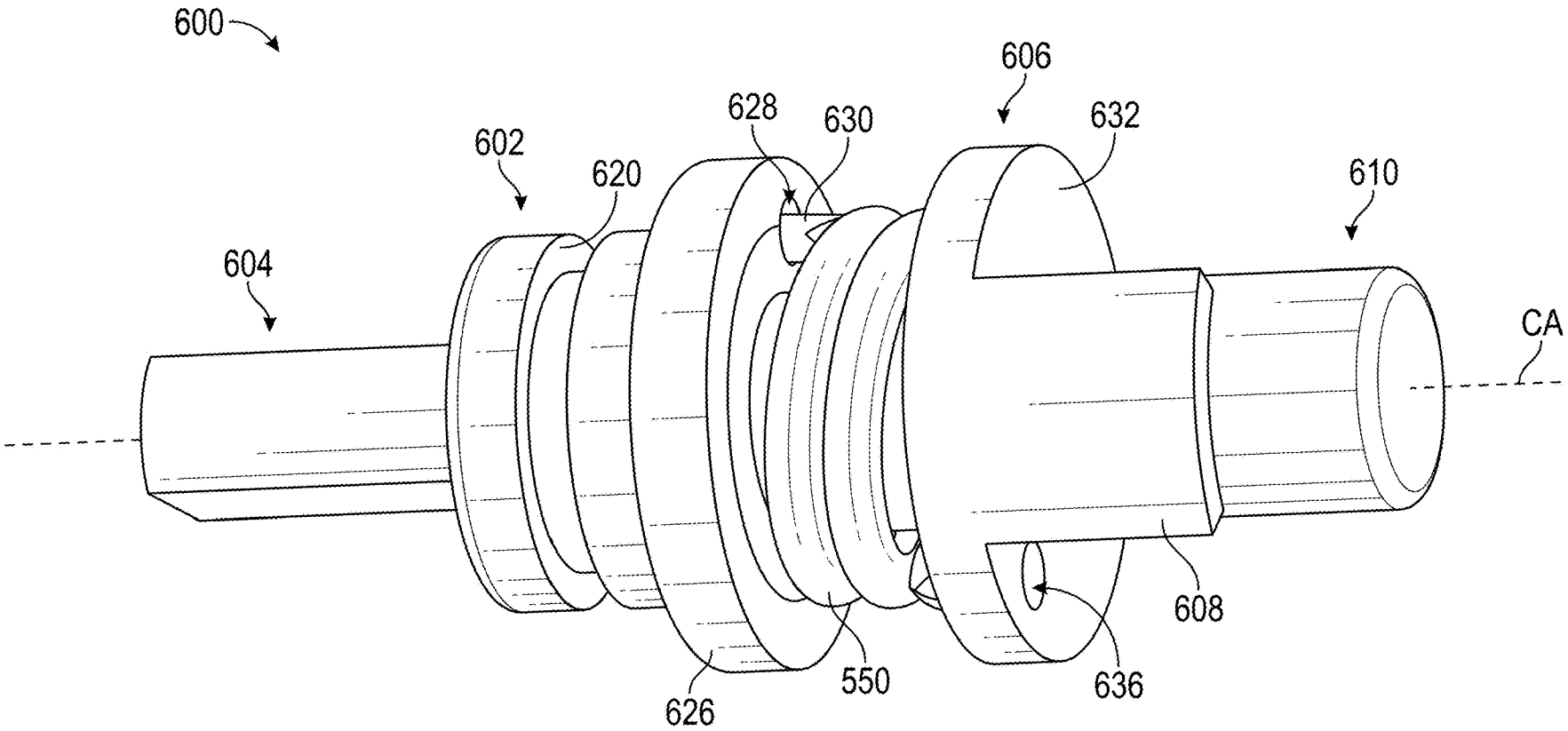
FIG. 6H illustrates a back perspective view of the plunger union of FIG. 6G.
Figure 6I:
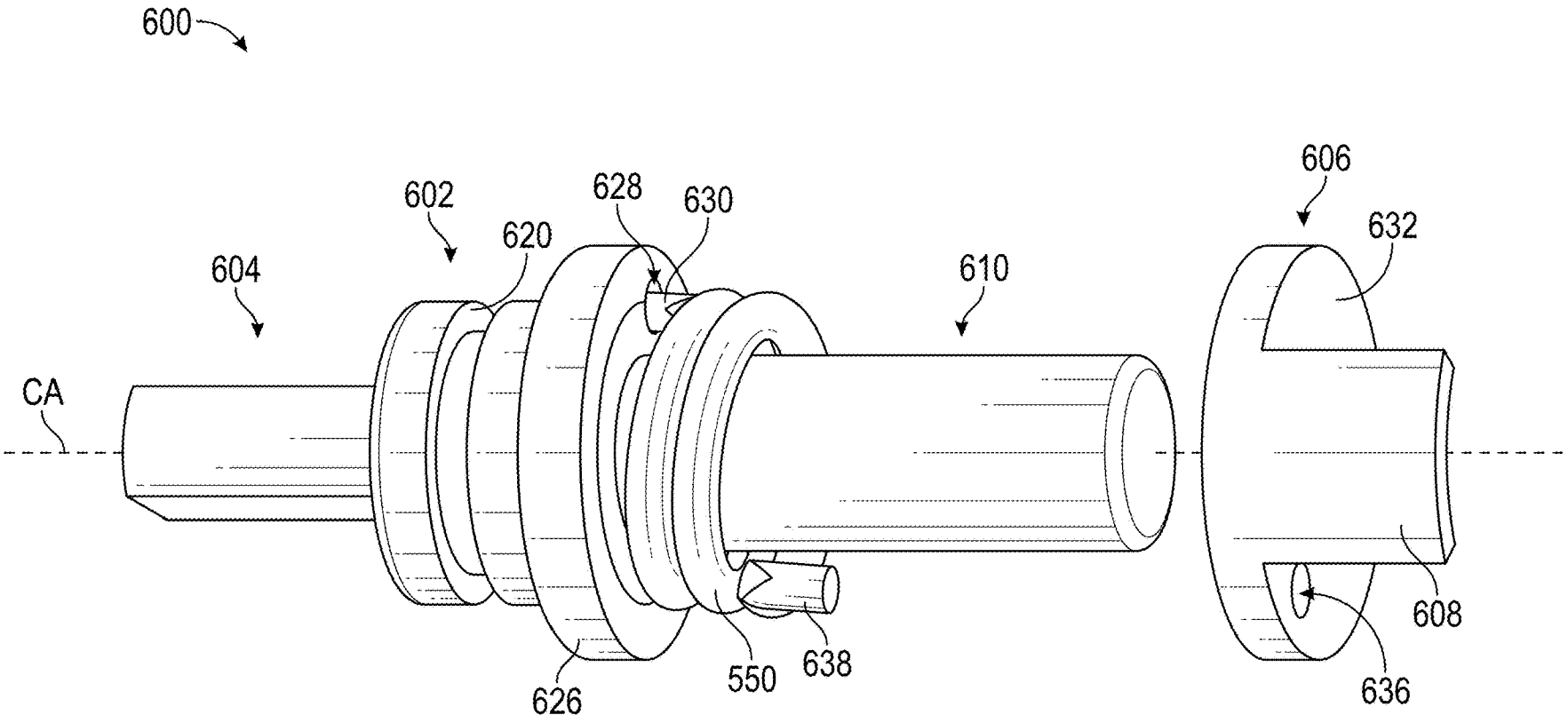
FIG. 6I illustrates an exploded back perspective view of the plunger union of FIG. 6H.

FIG. 6E illustrates the plunger union 600 with a pair of grooves 620. The grooves 620 can be positioned on the third portion 602. The grooves 620 can be offset from each other. The grooves 620 can extend around the circumference of the third portion 602. In some aspects, only one groove 620 is positioned on the third portion 602. In some aspects, more than two grooves 620 are positioned on the third portion 602. The grooves 620 can each receive an O-ring 624, shown in FIG. 6F. The O-rings 624 can reduce the risk that a fluid will reach the motor 800 while the drain fitting device 100 is in use and/or leak into the housing 216. The O-rings 624 can also help to align the plunger union 600 within the housing cover 700, described in more detail below. The O-rings can be particularly beneficial to alignment when the components of the drain fixture device 100 are injection molded. The O-rings 624 can be made of a polymer, such as rubber or silicon, or another suitable material.

As shown in FIG. 6E, the plunger union 600 can have a plurality of fillets. For example, the plunger union 600 can have a fillet 622 at the junction between the pair of curved engagement surfaces 618 and the third portion 602. The plunger union 600 can have a fillet 622 at an edge of the third portion 602 that is opposite the fourth portion 606. The plunger union 600 can have a fillet 622 at the junction between the third portion 602 and the fourth portion 606. The plunger union 600 can have a fillet 622 at an edge of the fourth portion 606 that is opposite the tab 608. The fillets can facilitate manufacture, assembly, and/or functionality of the plunger union 600 as discussed herein.

FIGS. 6G-6J illustrate various views and aspects of the plunger union 600 that can be used with a spring 550. The third portion 602 of the plunger union 600 can have a transfer flange 626. The transfer flange 626 can be positioned on the third portion 602. The transfer flange 626 can radially extend from the third portion 602. The transfer flange 626 can be a separate component that is connected to, mated with, and/or engaged with the third portion 602. The transfer flange 626 and the third portion 602 can be formed from a monolithic piece of material. The transfer flange 626 can have an opening, cutout, or divot 628 that can connect to, mate with, and/or engage with a first arm, pin, or extension 630 of the torsion spring 550.

Figure 6J:
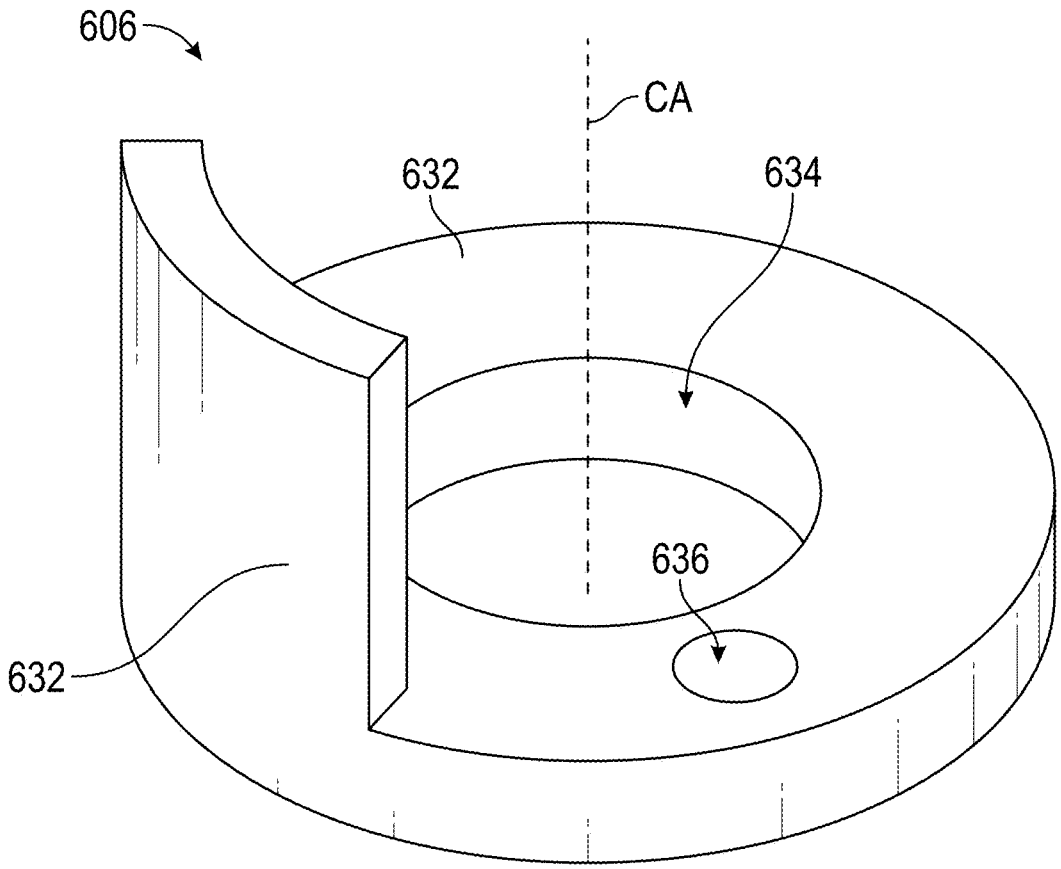
FIG. 6J illustrates an embodiment of a transfer plate.

The fourth portion 606 of the plunger union 600 can be positioned over the second portion 610. The second portion 610 can be considered a transfer shaft 610. The fourth portion 606 can be considered a transfer plate 606. The transfer plate 606 can be rotatably positioned onto the transfer shaft 610 along the central axis CA. The transfer plate 606 can have a transfer disc 632. As illustrated in FIG. 6J, the transfer disc 632 can have a central opening or hole 634 through which the transfer shaft 610 extends when assembled. The opening 634 can have a radius corresponding to the radius of the transfer shaft 610 to form a fit that allows for rotation between the transfer disc 632 and the transfer shaft 610 while minimizing radial movement between the transfer disc 632 and the transfer shaft 610. The fourth portion 606 can also have a tab 608 axially extending from the transfer disc 632. The tab 608 can extend from transfer disc 632 at the periphery of the transfer disc 632 and function as discussed herein, and in particular, in reference to FIGS. 9A-C.

The transfer disc 630 can have an opening, cutout, or divot 636 that can connect to, mate with, and/or engage with a first arm, pin, or extension 638 of the torsion spring 550. Accordingly, as transfer flange 626 rotates with the plunger union 600 rotating via a motor 800 as discussed herein, the torsion spring 550 can transfer the rotational torque and/or movement to the transfer disc 632, which in then turns or rotates the tab 608 as discussed herein. The tab 608 can contact the first plunger tab 516 and/or the second plunger tab 518 to move the stopper 310 as discussed herein.

The torsion spring 550 can function as an interface between the transfer flange 626 and the transfer disc 632 such that the transfer flange 626 and the transfer disc 632 are not directly connected or fixed to each other while allowing the transfer flange 626 to move the transfer plate 606 to move the stopper 310 as discussed herein. The torsion spring 550 can be positioned about the plunger union 600 along the central axis CA. In particular, the torsion spring 550 can be positioned about transfer shaft 610 along the central axis CA. The torsion spring 550 can be a coil spring wound about the transfer shaft 610 that can wind and unwind about the central axis CA to take up and release rotational movement of the transfer plate 606 in an elastic manner as discussed herein to help prevent damage to the motor 800.

This can advantageously reduce the risk that the drain fitting device 100 will break if a user steps onto the stopper 310 when the cam 400 is rotated up and engaged with the stopper 310 in an open position. When a user steps on the stopper 310, the first plunger tab 516 and/or the second plunger tab 518 will rotate in the second direction 822 (see FIGS. 9A-9C) via the cam 400 rotating in the second direction 822 from the stopper 310 moving downwardly and will cause the tab 608 (that is in contact with the first plunger tab 516 and/or the second plunger tab 518) to also rotate in the second direction 822. This will in turn cause the transfer disc 632 to rotate to wind or unwind the torsion spring 550 (with the first portion 604 not moving). In such an instance, it is the cam 400, the plunger 500, the transfer plate 606 that is rotating and not the rest of the plunger union 600, and in particular not the first portion 604, when the user has steps on the stopper 310 (without activating the motor to move in the second direction 822). Accordingly, the torsion spring 550 is wound or unwound from its resting state about the transfer shaft 610 to take up and absorb the movement of the transfer plate 606 without the first portion 604 moving. This helps prevent damage to the motor 800 that may be rotating the plunger union 600 in the first direction 820 (see FIGS. 9A-9C) or is stopped in a desired position for the stopper 310 to be up or in the open configuration as discussed herein by the motor 800 not being affected (motor components being components not moved or rotated) when the user steps on the stopper 310. When the user is no longer stepping on the stopper 310, the torsion spring 550 can release its elastic energy (against the transfer disc 632) to move the transfer disc 632 and the tab 608 back in the first direction 820 to return the stopper 310 to be up or in the open configuration without the motor 800 having been moved.

Figure 6K:
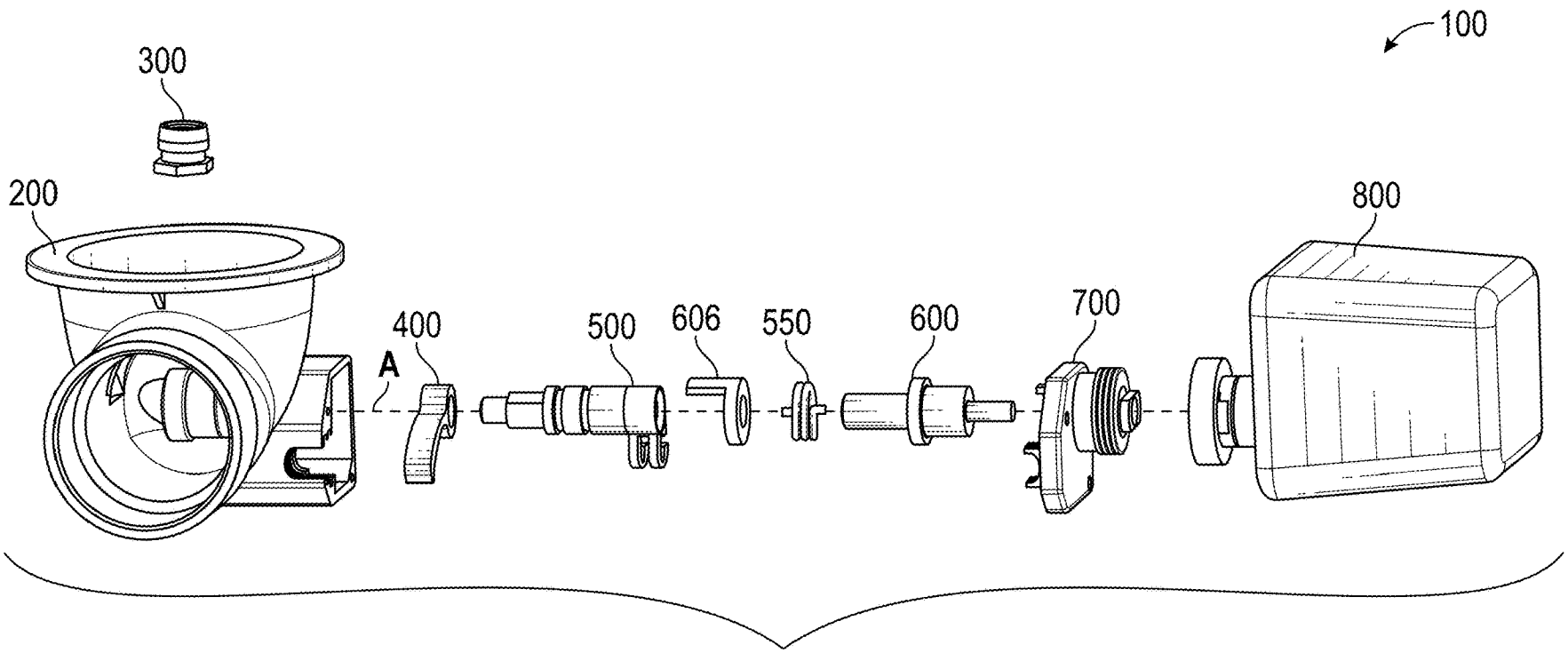
FIG. 6K illustrates an exploded view of an embodiment of a drain fitting device.

FIG. 6K illustrates an exploded view of a drain fitting device or assembly 100 using a plunger union 600 and torsion spring 550 as discussed in reference to FIGS. 6G-J. The drain fitting device 100 can be implemented in a bathing environment, such as a walk-in tub, standard tub, soaking tubs, whirlpool tub, shower, or other bathing system, including bath tubs, to facilitate the retention or drainage of fluid in or from the bathing environment.

Figure 7A:
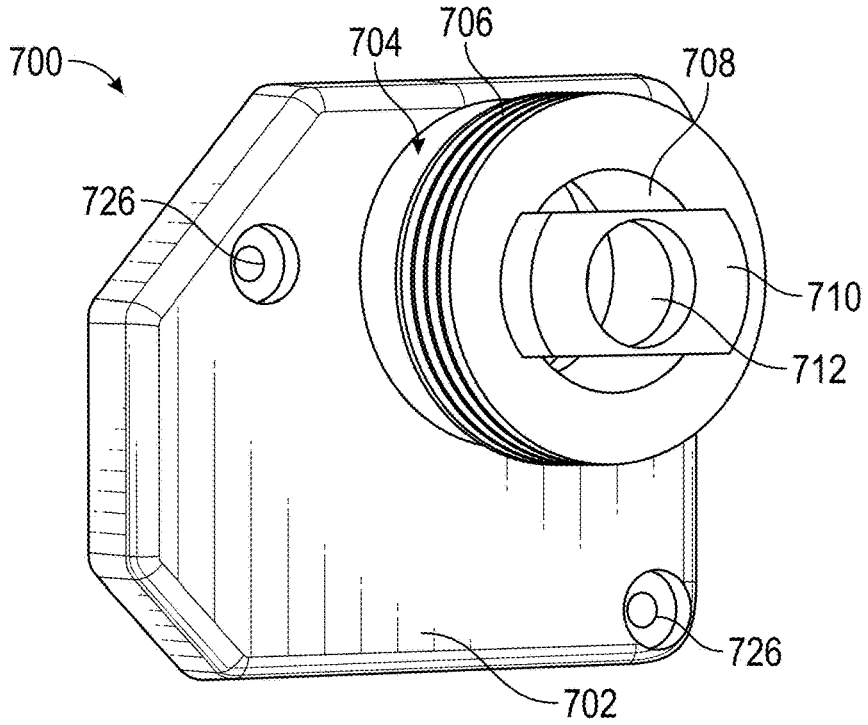
FIG. 7A illustrates a front perspective view of an embodiment of a housing cover.
Figure 7B:
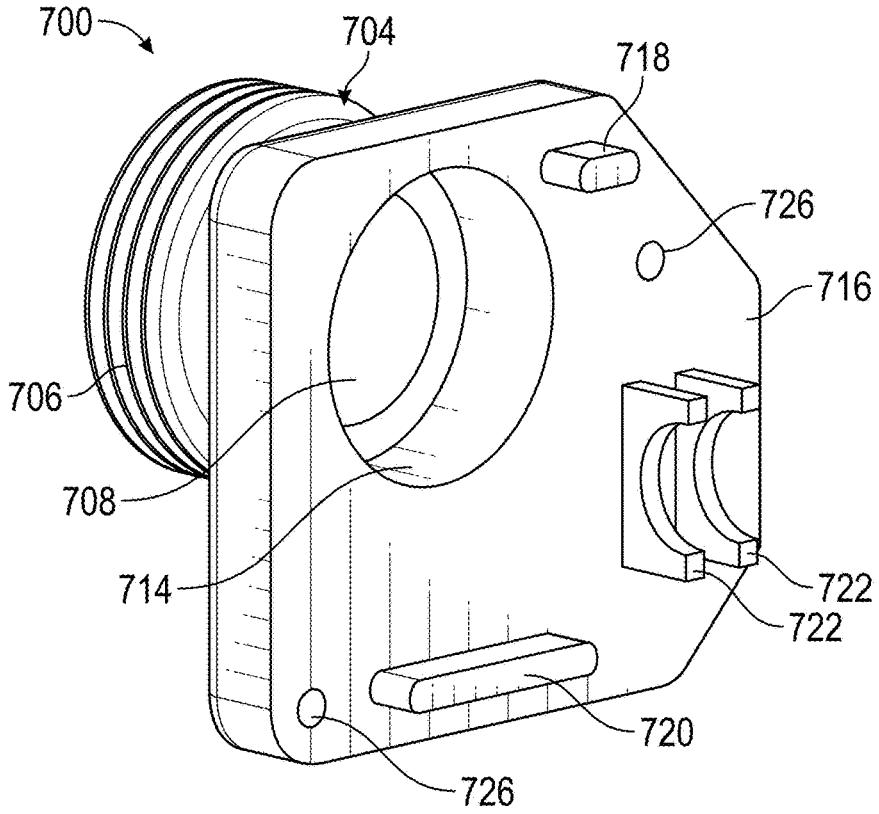
FIG. 7B illustrates a back perspective view of the housing cover of FIG. 7A.

FIGS. 7A-7B illustrate various view and aspects of the housing cover 700. As shown in FIG. 7A, the housing cover 700 can have a front face 702. An extrusion 704 can extend away from the front face 702, which can include perpendicularly away from the front face 702. The extrusion 704 can be cylindrical in shape (e.g., a cylindrical extrusion), having a circular outer periphery. Threads 706 can be positioned on a periphery of the extrusion 704. The threads 706 can facilitate coupling the housing cover 700 to the motor 800.

As seen in FIG. 7B, the housing cover 700 can have a back face 716. The back face 716 can be positioned opposite the front face 702. The front face 702 and the back face 716 can be parallel to each other. The housing cover 700 can have a first cavity 708 and/or a second cavity 714. In some aspects, the first cavity 708 extends through the extrusion 704. In some aspects, the second cavity 714 extends from the back face 716 to the front face 702. The first cavity 708 and/or second cavity 714 can have a circular cross-section. The first cavity 708 can be positioned coaxially with the second cavity 714. The first cavity 708 and/or the second cavity 714 can receive a portion of the plunger union 600. The second cavity 714 can receive at least a portion or all of the fourth portion 606 of the plunger union 600. The first cavity 708 can receive at least a portion or all of the third portion 602 of the plunger union 600.

When the plunger union 600 is coupled with the housing cover 700, the third portion 602 can contact a panel 710, illustrated in FIG. 7A. The panel 710 can extend across an opening of the first cavity 708. In some aspects, the panel 710 ensures that the plunger union 600 is maintained in position while the drain fitting device 100 is in use. The panel 710 can partially cover the opening to the first cavity 708, which can include leaving the opening to the first cavity 708 uncovered on either side of the panel 710. The panel can have a periphery defined, at least in part, by a pair of flat opposing surfaces that are joined by a pair of curved opposing surfaces. The panel 710 can include a through hole 712. The through hole 712 can be circular. The through hole 712 can be sized to receive the first portion 604 of the plunger union 600, such that the first portion 604 can extend out of the housing cover 700 to engage with the motor 800 and rotate.

As shown in FIG. 7B, the housing cover 700 can have a first protrusion 718. The first protrusion 718 can have an elongate shape with rounded ends. The first protrusion 718 can be positioned on an upper portion of the back face 716. The housing cover can have a second protrusion 720. The second protrusion 720 can have an elongate shape with rounded ends. The second protrusion 720 can be positioned on a lower portion of the back face 716. The second protrusion 720 can be larger than the first protrusion 718. The first protrusion 718 and/or the second protrusion 720 can align the housing cover 700 within the housing 216 of the drain fitting 200. The housing cover 700 can have a pair of flanges 722 positioned on the back face 716. The flanges 722 can be offset and/or parallel from each other. The flanges 722 can include a curved cutout, such as a semi-circle. The flanges 722 can engage with a portion of a cable device that interacts with the plunger 500 to facilitate rotating the plunger 500. A pair of coupling apertures 726 can extend through the housing cover 700 to facilitate the coupling of the housing cover 700 to the housing 216. In some aspects, the housing cover 700 includes one coupling aperture 726 or more than two coupling apertures 726.

Figure 8:
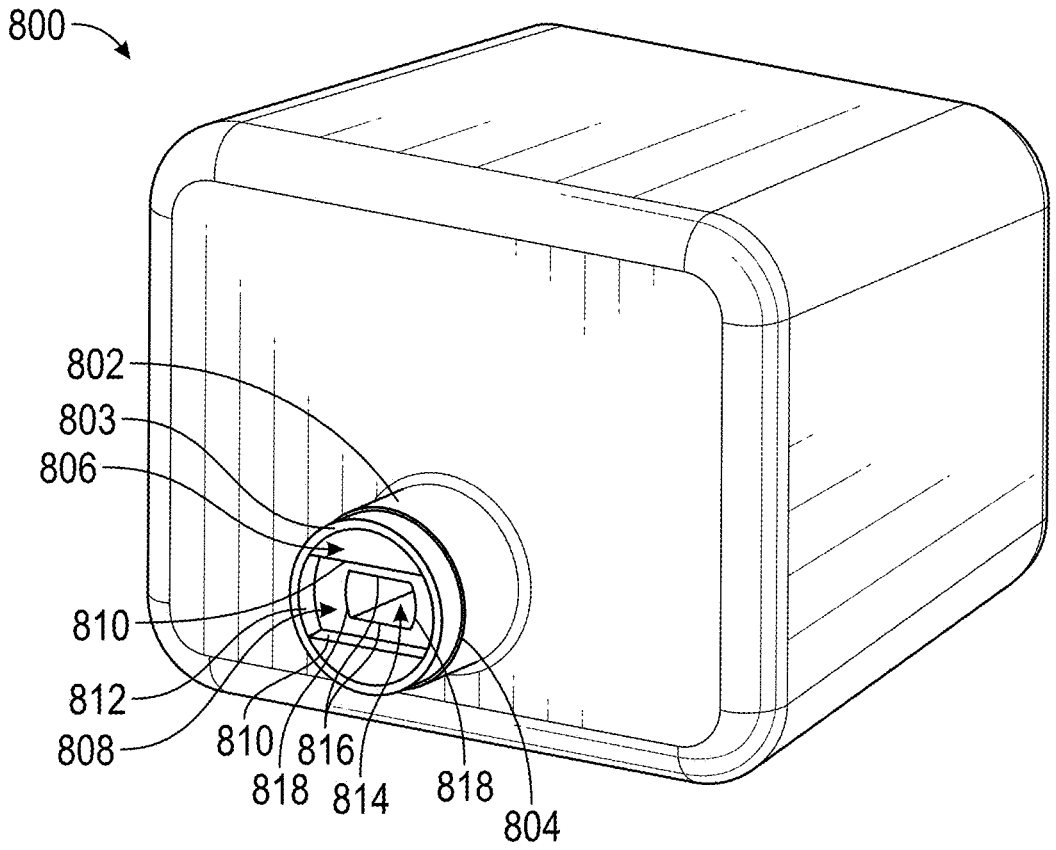
FIG. 8 illustrates an embodiment of a motor.

FIG. 8 illustrates a motor 800. The motor 800 can include a projection 802. The projection 802 can have a cylindrical cross-section. A front portion 803 can be positioned on an end of the projection 802. The front portion 803 can have a periphery that is the same as the projection 802. A groove 804 can be positioned between the projection 802 and the front portion 803. The front portion 803 can have a first recess 806. The first recess 806 can be circular. The front portion 803 can have a second recess 808. The second recess 808 can receive the panel 710 of the housing cover 700. The second recess 808 can include a pair of second curved engagement surfaces 812 and/or a pair of second flat engagement surfaces 810. The pair of second flat engagement surfaces 810 can be offset from each other with the pair of second curved engagement surfaces 812 extending between them.

The front portion 803 can include slot 814. The slot 814 can receive the first portion 604 of the plunger union 600. The slot 814 can include a pair of flat engagement surfaces 816 and/or a pair of curved engagement surfaces 818. The pair of flat engagement surfaces 816 can be offset from each other. The pair of curved engagement surfaces 818 can extend between the pair of flat engagement surfaces 816. The pair of curved engagement surfaces 818 of the slot 814 can interface with the pair of curved engagement surfaces 618 of the first portion 604 of the plunger union 600 such that the rotation of the slot 814 by the motor 800 results in the rotation of the plunger union 600 when the drain fitting device 100 is assembled. In some aspects, the motor 800 is limited to rotating the slot 814 to a set position or limited degree amount. For example, the motor 800 can be limited to rotating within a 180 degree range of motion or other ranges such as within less than 90, 90, 100, 110, 120, 130, 140, 150, 160, 170, 180, 190, 200, 210, 220, 230, 240, 250, 260, 270, or more than 270 degrees in range of motion. In some aspects, the motor 800 has switches that limit the range of motion such that the motor 800 rotates the slot 814 until triggering a switch that stops the rotation of the slot 814 and the plunger union 600.

The motor 800 can be an electric motor. The motor 800 can be activated by a user to rotate the slot 814, which can ultimately result in the rotation of the cam 400 in a first direction to push a stopper 310 into an open position or in a second direction to allow the stopper 310 to be placed into a closed position. As described herein, the motor 800 can be controlled with a user interface, such as a button or other suitable manner. The motor 800 can include a capacitor that can be charged when the motor 800 is connected to power.

The capacitor can be included as a safety feature to ensure that the cam 400 can be rotated without the motor 800 having immediate access to power. In some aspects, the capacitor automatically discharges, rotating the slot 814, when the motor 800 is shutoff or power is lost. This can advantageously enable a user to drain a bathing environment even without access to power. This can advantageously enable a user to drain a bathing environment by simply pushing a button, which can be easier than grabbing a lever in wet conditions. In some aspects, the capacitor provides the necessary power to rotate the slot 814 such that the cam 400 is moved in the first direction to push the stopper 310, unplugging the drain inlet 202 to allow fluid to flow through the drain inlet 202 of the drain fitting 100. In some aspects, the capacitor provides the necessary power to rotate the slot 814 such that the cam 400 is moved in the second direction so that the cam 400 does not interact with the stopper 310, enabling the stopper 310 to be placed in a closed position that prevents the flow of fluid through the drain inlet 202. This can advantageously enable a user to move the cam 400, even without power, to plug the drain inlet 202 and fill a bathing environment.

In some embodiments, the motor 800 can be any other suitable actuator to rotate the plunger union 600 as discussed herein. The actuator may be a solenoid, thermal motor, or other actuator means. For example, the actuator may be a secondary or another manual pull mechanism or cable assembly as described herein in reference to tabs 516, 518. The plunger union 600 may be connected to a cable that can rotate the plunger union 600 and consequently the cam 400 as discussed herein via a user pulling on or moving a handle or lever connected to a cable that rotates the plunger union 600.

Figure 9A:
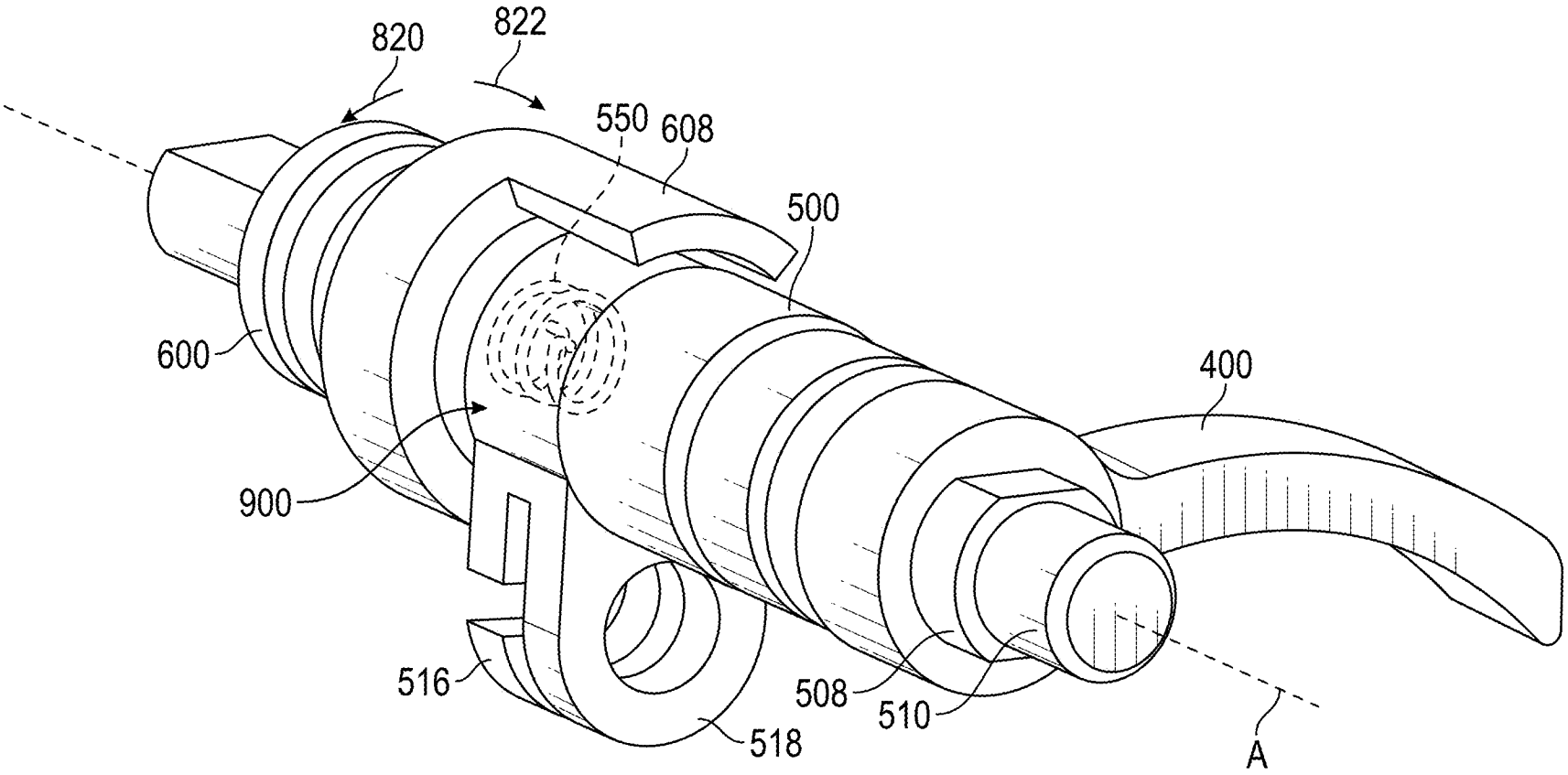
FIG. 9A illustrates an embodiment of a cam, plunger, and plunger union assembled together.

FIGS. 9A-11B illustrate different components of the drain fitting device 100 assembled together. FIGS. 9A-9C illustrates the cam 400, plunger 500, and plunger union 600 assembled together. During assembly, the plunger 500 and the cam 400 would be assembled with the cam 400 positioned in the cam aperture 220 of the housing 216. The plunger 500 and the cam 400 are coupled together, as shown in FIGS. 9A-C, for illustrative purposes. As shown, the plunger 500 can be received within the plunger-receiving aperture 404 of the cam 400, rotatably coupling them together, with a portion of the cam-engagement portion 508 and the third cylindrical portion 510 extending beyond the plunger-receiving aperture 404. The second portion 610 of the plunger union 600 can be positioned within the first receiving aperture 526 and/or the second receiving aperture 528 such that the plunger 500 and the plunger union 600 are rotatably coupled together.

Once assembled, the tab 608 of the plunger union 600 can be offset from the plunger 500. The tab 608 can extend along and/or parallel to the central axis CA the plunger union 600, including the central axis CA of the plunger 500 when assembled. The tab 608 can extend along and offset from the outer surface of the plunger 500. A gap 900 can extend between the outer surface of the plunger and the tab 608. The gap 900 can be smaller than the gap 614 previously described. As shown, the plunger 500 can rotate independently from the plunger union 600 until contacting the tab 608.

Figure 9B:
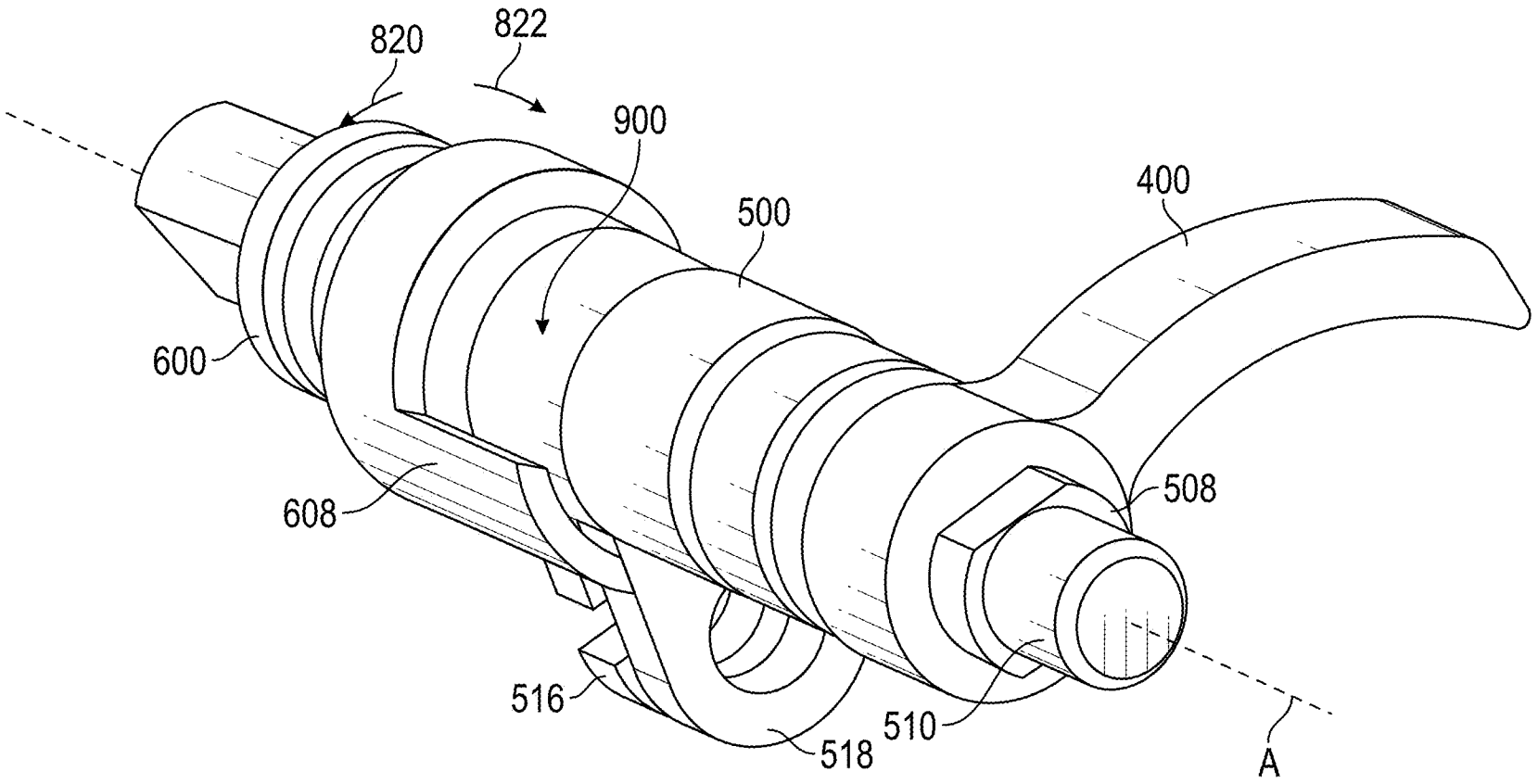
FIG. 9B illustrates the cam, plunger, and plunger union assembled together.

Referring to FIG. 9B, the motor 800 can rotate the plunger union 600 in a first rotation direction 820 (e.g., the first direction) about the rotation axis A. With the plunger union 600 being rotated in the first rotation direction 820, the tab 608 is rotated in the first rotation direction 820 about the rotation axis A. The tab 608 rotates in the first rotation direction 820 to come in contact with the first plunger tab 516 and/or the second plunger tab 518 as illustrated in FIG. 9B. As the first plunger tab 516 and/or the second plunger tab 518 are rotated in the first rotation direction 820 by the tab 608, the plunger 500 is rotated in the first rotation direction 820 about the rotation axis A. As the plunger 500 is rotated in the first rotation direction 820 by the first plunger tab 516 and/or the second plunger tab 518 being rotated, the cam 400 is rotated by the plunger 500 in the first rotation direction 820 about the rotation axis A. As shown in FIG. 9B relative to FIG. 9A, the cam 400 is illustrated as having been rotated in the first rotation direction 820 (e.g., in a counter clockwise direction from the viewing angle of FIG. 9B). FIG. 9A illustrates the cam 400 in a disengaged position.

Figure 9C:
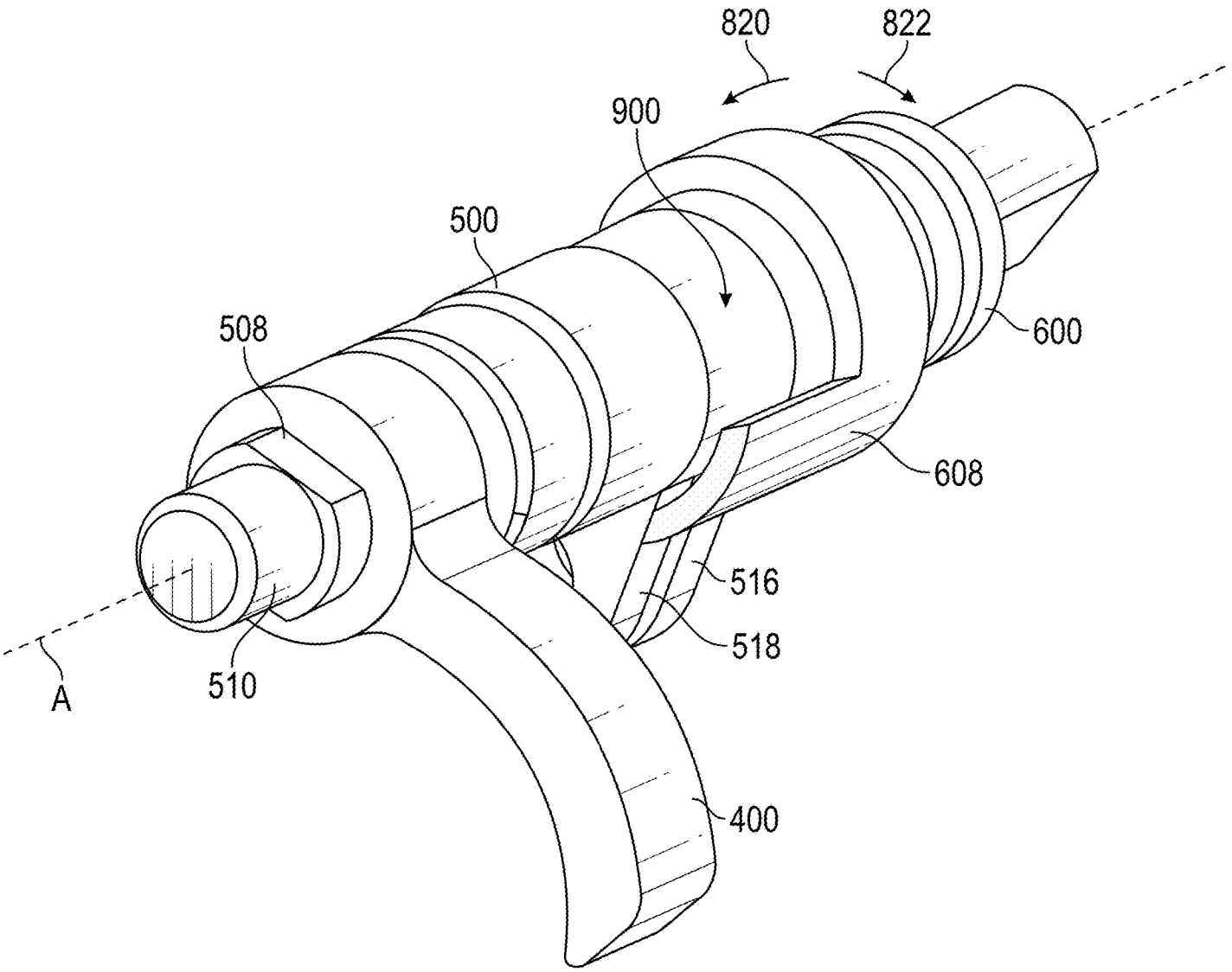
FIG. 9C illustrates the cam, plunger, and plunger union assembled together.

Referring to FIG. 9C, the motor 800 can rotate the plunger union 600 in a second rotation direction 822 (e.g., the second direction) about the rotation axis A. With the plunger union 600 being rotated in the second rotation direction 822, the tab 608 is rotated in the second rotation direction 822 about the rotation axis A. The tab 608 rotates in the second rotation direction 822 to come in contact with the first plunger tab 516 and/or the second plunger tab 518 as illustrated in FIG. 9C. As the first plunger tab 516 and/or the second plunger tab 518 are rotated in the second rotation direction 822 by the tab 608, the plunger 500 is rotated in the second rotation direction 822 about the rotation axis A. As the plunger 500 is rotated in the second rotation direction 822 by the first plunger tab 516 and/or the second plunger tab 518 being rotated, the cam 400 is rotated by the plunger 500 in the second rotation direction 822 about the rotation axis A. As shown in FIG. 9C relative to FIG. 9A, the cam 400 is illustrated as having been rotated in the second rotation direction 822 (e.g., in a clockwise direction from the viewing angle of FIG. 9C).

Referring to FIG. 9A, in some embodiments, a spring, torsional spring, or elastic member 550 may be provided between the plunger 500 and the plunger union 600. The spring 550 may be positioned about and/or wrap around the plunger 500 and/or the plunger union about the central axis CA. The spring 550 may be in contact, engage, or interact with the tab 608 and the first plunger tab 516 and/or the second plunger tab 518 to provide for an elastic movement between the tab 608 and the first plunger tab 516 and/or the second plunger tab 518. The tab 608 may not contact the first plunger tab 516 and/or the second plunger tab 518 in order to move the plunger 500 via the plunger union 600 as discussed herein. Specifically, as movements of the plunger 500, plunger union 600, and cam 400 occur as discussed in reference to FIGS. 9B and 9C, the tab 608 may not be directly touching the first plunger tab 516 and/or the second plunger tab 518 in order for the cam 400 to rotate via the spring 550 being between the tab 608 and the first plunger tab 516 and/or the second plunger tab 518.

When in the assembly is the position illustrated in FIG. 9B where the cam 400 has pushed or moved up the stopper 310, the spring 550 may separate the tab 608 and the first plunger tab 516 and/or the second plunger tab 518 from each other instead of being in direct contact as illustrated in FIG. 9B. This can advantageously reduce the risk that the drain fitting device 100 will break if a user steps onto the stopper 310 when the cam 400 is rotated up and engaged with the stopper 310 in an open position. When a user steps on the stopper 310, the first plunger tab 516 and/or the second plunger tab 518 have radial room or space to rotate in the second direction 822 toward the tab 608 that is separated by the spring 550. In such an instance, it is the cam 400 and the plunger 500 that is rotating and not the plunger union 600 when the user has steps on the stopper 310. This helps prevent damage to the motor 800 that may be rotating the plunger union 600 in the first direction 820 or is stopped in a desired position for the stopper 310 to be up or in the open configuration as discussed herein by the motor 800 not being affected (motor components being not moved or rotated) when the user steps on the stopper 310. When the user is no longer stepping on the stopper 310, the spring 550 can release its elastic energy (against the tab 608) to move the first plunger tab 516 and/or the second plunger tab 518 back in the first direction 820 to return the stopper 310 to be up or in the open configuration without the tab 608 or the motor 800 having been moved.

The surface of the second portion 610 of the plunger union 600 can be a first radius from the center axis of the plunger union 600, including the central axis CA of the plunger 500 when assembled. The surface of the second receiving aperture 528 can be at a second radius form the center axis of the plunger union 600, including the central axis CA of the plunger 500 when assembled. The surface of the plunger 500 can be at a third radius from the center axis of the plunger union 600, including the central axis CA of the plunger 500 when assembled. The surface of the tab 608 can be at a fourth radius from the central axis of the plunger union 600, including the central axis CA of the plunger 500 when assembled. The first radius can be smaller than the second radius. The second radius can be smaller than the third radius. The third radius can be smaller than the fourth radius.

In use, a cable device can couple to the first plunger tab 516 and/or the second plunger tab 518. A user can manipulate a lever to pull or push the first plunger tab 516 and/or the second plunger tab 518, resulting in the movement of the cam 400 in the first direction or the second direction. A user can activate the motor 800 to rotate the plunger union 600. The plunger union 600 can rotate independently of the plunger 500 until the tab 608 interfaces with the first plunger tab 516 and/or the second plunger tab 518 as discussed herein. In some aspects, the motor 800 has or is programmed with a limited rotational range of motion such that the motor 800 can rotate the plunger union 600 in the first rotational direction 820 to cause the cam 400 to push the stopper 310 to an open position (e.g., as illustrated in FIG. 9B) while allowing rotation in the second rotation direction 822 only up to rotating the plunger union 600 such that the tab 608 is positioned to not obstruct the plunger 500 rotating the cam 400 in the second direction (e.g., as illustrated in FIG. 9A), enabling the stopper 310 to be placed in the closed position.

Figure 10:
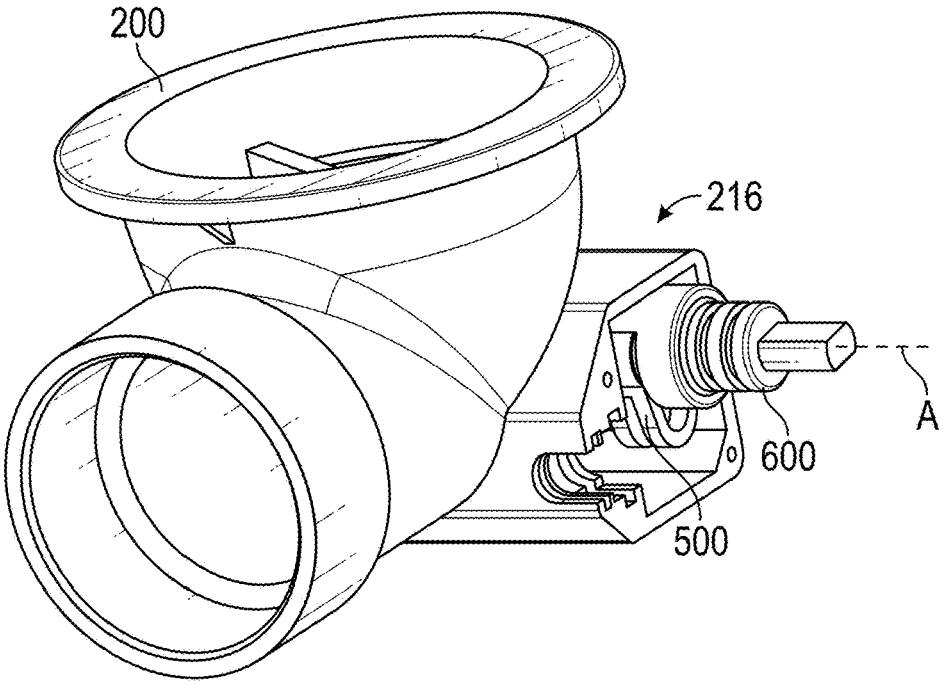
FIG. 10 illustrates an embodiment of the assembly of FIG. 9A interfaced with the drain fitting.
Figure 11A:
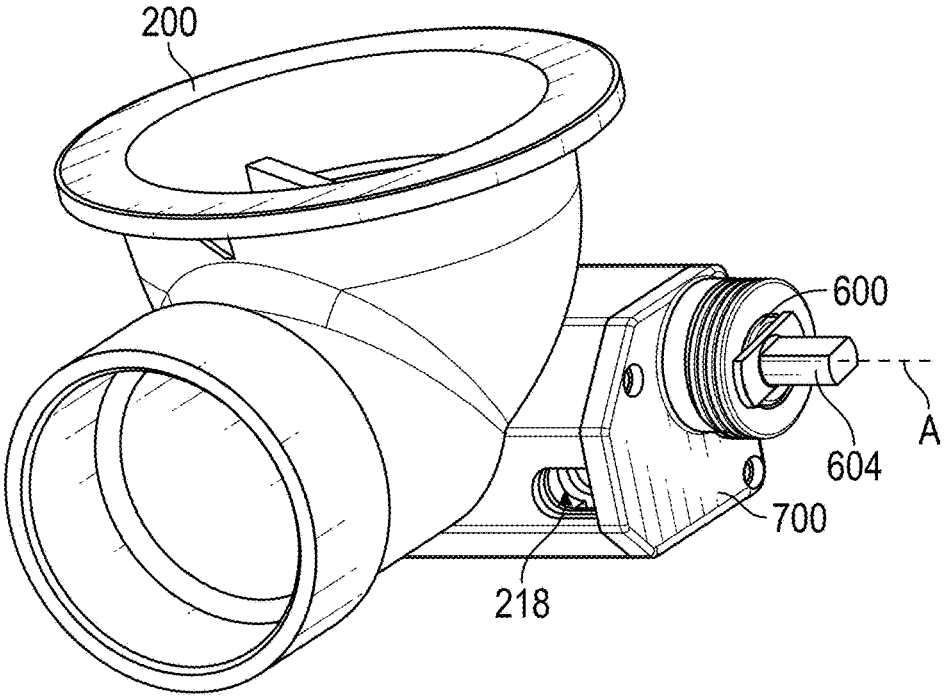
FIG. 11A illustrates an embodiment of the housing cover coupled to the drain fitting, enclosing the assembly of FIG. 9A.
Figure 11B:
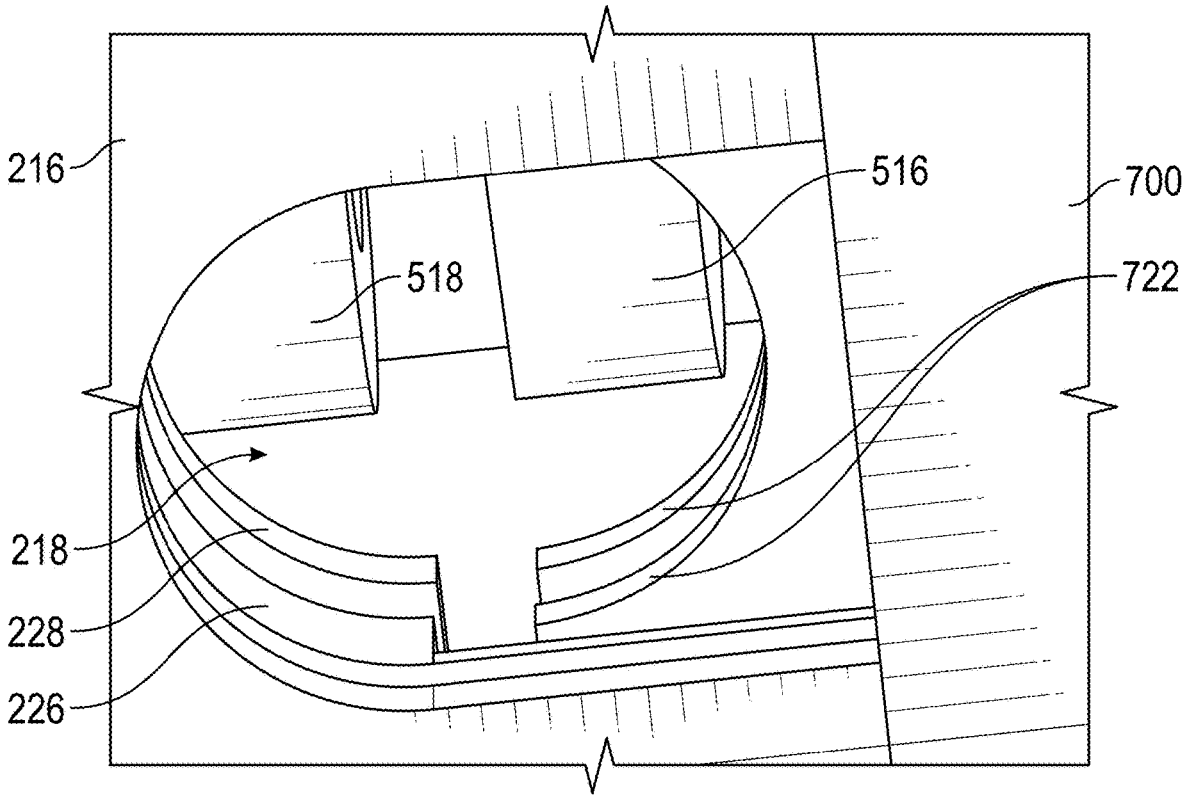
FIG. 11B illustrates an enlarged view of an embodiment of a portion of the coupling between the housing cover and a housing of the drain fitting.

FIG. 10 illustrates the cam 400, plunger 500, and plunger union 600 assembled to the drain fitting 200. The plunger 500 and plunger union 600 can be positioned within the housing 216. As explained above, the third cylindrical portion 510 can be positioned into the second socket 224 of the housing 216 and the main cylinder portion 502 in the first socket 222 of the housing 216. As shown in FIG. 11A, the housing cover 700 can be coupled to the housing 216, enclosing the plunger 500 and plunger union 600. The first portion 604 can extend through the housing cover 700 such that the first portion 604 can engage with the motor 800, as shown in FIGS. 1B and 1C. FIG. 11B illustrates an enlarged view of the access aperture 218, shown in FIG. 11A. FIG. 11B illustrates the first housing flange 226 and the second housing flange 228 positioned opposite the flanges 722 of the housing cover 700, forming an aperture and periphery through which a cable device can interact with the plunger 500 to cause rotation.

Various embodiments and examples of assemblies have been disclosed. Although the assemblies have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above.

What is claimed is:

1. A drain fitting device for draining a bathing environment, the drain fitting device comprising:

a drain inlet and a drain outlet, wherein a drain periphery extends between the drain inlet and the drain outlet to define a chamber, the chamber being configured to direct fluid from the drain inlet to the drain outlet;

a cam positioned within the chamber, the cam being configured to rotate in a first direction such that the cam pushes a stopper into an open position that allows fluid to flow through the drain inlet, and wherein the cam is configured to rotate in a second direction such that the cam does not engage the stopper, enabling the stopper to be in a closed position that prevents flow of fluid through the drain inlet;

a plunger rotatably coupled to the cam, the plunger comprising a plunger tab radially extending from the plunger, the plunger tab configured to interface with a cable of a handle lever such that rotating the handle lever manipulates the cable to cause the plunger to rotate, resulting in the cam rotating in the first direction or the second direction;

a plunger union that interfaces with the plunger, the plunger union comprising a plunger union tab axially extending from the plunger union, the plunger union tab configured to engage the plunger tab of the plunger such that the plunger rotates with the plunger union, and wherein the plunger union is configured to rotate to a disengaged position in which the plunger union tab is not engaging the plunger tab of the plunger, enabling the plunger to rotate relative to the plunger union; and a motor configured to rotate the plunger union, wherein the rotation of the plunger union engages the plunger union tab with the plunger tab of the plunger, causing the plunger to rotate with the plunger union such that the cam is rotated in the first direction so that the stopper is pushed into an open position, allowing fluid to flow through the drain inlet.

2. The drain fitting device of claim 1, wherein the motor is an electric motor comprising a capacitor that is configured to store energy such that the motor can rotate the plunger union without an external power source.

3. The drain fitting device of claim 1, wherein the plunger comprises a central aperture that is configured to receive a portion of the plunger union.

4. The drain fitting device of claim 3, wherein the portion of the plunger union is configured to be inserted into the central aperture of the plunger such that the plunger union tab of the plunger union is offset from an outer surface of the plunger.

5. The drain fitting device of claim 4, wherein the plunger union tab is curved and comprises a radius of curvature corresponding to a curvature of an outer surface of the portion of the plunger union.

6. The drain fitting device of claim 1, wherein the plunger comprises grooves configured to receive o-rings to prevent fluid from leaking from the chamber.

7. The drain fitting device of claim 1, wherein the plunger union comprises grooves configured to receive o-rings to prevent fluid from contacting the motor.

8. The drain fitting device of claim 1, wherein the cam comprises a lever that is configured to interface with the stopper, and wherein the lever comprises two curved elongate surfaces and two flat parallel surfaces.

9. The drain fitting device of claim 1, wherein plunger tab two offset tabs comprise the plunger tab, and wherein each of the two offset tabs comprises an aperture, the aperture configured to interface with the cable of the handle lever.

10. The drain fitting device of claim 1, wherein the motor is configured to rotate the plunger union until triggering a switch, causing the motor to stop the rotation of the plunger union.

11. The drain fitting device of claim 1, further comprising a torsional spring positioned about the plunger union, wherein the plunger union comprises a torsional flange and a torsional plate, wherein the torsional plate is fixed to the plunger union and the torsional plate is configured to rotate relative to the plunger union, the torsional plate connected to the plunger union tab, wherein the torsional spring interfaces between the torsional flange and the torsional plate such that rotation of the torsional flange via the plunger union rotating causes rotation of the plunger plate to rotate the plunger union tab.

12. A drain fitting device, the drain fitting comprising:

a drain inlet and a drain outlet, wherein a drain periphery extends between the drain inlet and the drain outlet to define a chamber that is configured to direct fluid from the drain inlet to the drain outlet;

a claw positioned within the chamber, the claw being configured to rotate in a first direction to push a stopper into an open position that allows fluid to flow through the drain inlet, and wherein the claw is configured to rotate in a second direction such that the claw does not interact with the stopper, enabling the stopper to be in a closed position that prevents flow of fluid through the drain inlet;

a plunger rotatably coupled to the claw, the plunger comprising a plunger tab that is configured to interface with a cable of a handle lever such that rotating the handle lever manipulates the cable to cause the plunger to rotate, resulting in the claw rotating in the first direction or the second direction;

a plunger union that interfaces with the plunger, the plunger union comprising a union tab that is configured to move the plunger tab such that the plunger rotates with the plunger union, and wherein the plunger union is configured to rotate to a disengaged position in which the union tab is not engaging the plunger tab, enabling the plunger to rotate freely relative to the plunger union; and an actuator configured to rotate the plunger union, wherein the rotation of the plunger union engages the union tab with the plunger tab causing the plunger to rotate such that the claw is rotated in the first direction so that the stopper is pushed into an open position, allowing fluid to flow through the drain inlet.

13. The drain fitting device of claim 12, wherein the actuator comprises at least one of an electric motor, a solenoid, a thermal motor, or a cable assembly.

14. A drain fitting comprising:

a drain inlet and a drain outlet, wherein a drain periphery extends between the drain inlet and the drain outlet to define a chamber, the chamber being configured to direct fluid from the drain inlet to the drain outlet;

a cam positioned within the chamber, the cam being configured to rotate in a first direction such that the cam pushes a stopper into an open position that allows fluid to flow through the drain inlet, and wherein the cam is configured to rotate in a second direction such that the cam does not engage the stopper, enabling the stopper to be in a closed position that prevents fluid to flow through the drain inlet;

a plunger rotatably coupled to the cam, the plunger comprising a first tab configured to rotate the cam in the first direction or the second direction; and a plunger union that interfaces with the plunger, the plunger union comprising a second tab that is configured to move first tab of the plunger to rotate the plunger as plunger union is rotated, and wherein the plunger union is configured to rotate to a disengaged position in which the second tab is not engaging the first tab of the plunger to allow the plunger to rotate relative to the plunger union.

15. The drain fitting of claim 14, wherein the plunger union comprises a cylindrical body configured to rotate about a central axis of the plunger and the plunger union.

16. The drain fitting of claim 15, wherein the second tab extends along the cylindrical body parallel to the central axis.

17. The drain fitting of claim 15, wherein the first tab extends from the plunger perpendicular to the central axis.

18. The drain fitting of claim 15, wherein the plunger comprises an aperture centered on the central axis, wherein a portion of the plunger union is configured to extend into the aperture.

19. The drain fitting of claim 18, wherein the second tab is configured to extend along the central axis along an outer surface of the plunger with the portion of the plunger in the aperture.

20. The drain fitting of claim 19, wherein the first tab extends from the outer surface of the plunger at a position to engage the second tab about the central axis with the portion of the plunger union in the aperture of the plunger.

21. The drain fitting of claim 18, wherein a surface of the portion of the plunger union is at a first radius from the central axis, a surface of the aperture is at a second radius from the central axis, a surface of the plunger is at a third radius from the central axis, and a surface of the second tab is at a fourth radius from the central axis, wherein the first radius is smaller than the second radius, the second radius is smaller than the third radius, and the third radius is smaller than the fourth radius.

22. The drain fitting of claim 14, wherein the plunger union comprises a first portion that comprises a pair of flat engagement surfaces with a pair of curved engagement surfaces extending therebetween, and wherein the first portion is configured to interface with a motor configured to rotate the plunger union.

23. The drain fitting of claim 22, the drain fitting further comprising:

a housing within with which the plunger and plunger union are at least partially positioned; and a housing cover that is configured to couple to the housing, wherein the housing cover comprises a cavity to receive the plunger union, and wherein the first portion of the plunger union extends through the housing cover.

24. The drain fitting of claim 23, wherein the cavity extends through the housing cover, wherein a panel covers at least a portion of an opening of the cavity, and wherein the first portion of the plunger union extends through a hole in the panel.

25. The drain fitting of claim 23, wherein the cavity is at least partially positioned within a cylindrical extrusion of the housing cover, and wherein the drain periphery of the cylindrical extrusion includes threads that are configured to facilitate a connection with a motor configured to rotate the plunger union.

26. The drain fitting of claim 14, further comprising a spring positioned on the plunger union, wherein the plunger union comprises a torsional flange and a torsional plate, wherein the torsional plate is fixed to the plunger union and the torsional plate is configured to rotate relative to the plunger union, the torsional plate connected to the second tab, wherein the spring interfaces between the torsional flange and the torsional plate such that movement of the torsional flange via the plunger union moving causes movement of the plunger plate to move the second tab.

* * * * *